US006811494B2

(12) United States Patent
Tamura et al.

(10) Patent No.: US 6,811,494 B2
(45) Date of Patent: Nov. 2, 2004

(54) SHOOTING GAME MACHINE AND SHOOTING GAME SYSTEM

(75) Inventors: Yuji Tamura, Akashi (JP); Hirofumi Nagao, Kobe (JP); Satoshi Ueda, Kobe (JP); Nozomu Nonomura, Kobe (JP)

(73) Assignee: Konami Corporation, Tokyo (JP)

( * ) Notice: Subject to any disclaimer, the term of this patent is extended or adjusted under 35 U.S.C. 154(b) by 209 days.

(21) Appl. No.: 09/960,671

(22) Filed: Sep. 21, 2001

(65) Prior Publication Data

US 2002/0037771 A1 Mar. 28, 2002

(30) Foreign Application Priority Data

Sep. 25, 2000 (JP) ..... 2000-290997

(51) Int. Cl.[7] ..... A63B 67/06; F41F 1/00

(52) U.S. Cl. ..... 463/53; 273/126 R; 124/29

(58) Field of Search ..... 463/36, 46–47, 463/53–57; 273/354–357, 317, 317.1, 348, 351, 371, 378, 394, 398, 126 R, 126 A, 148 R, 459–461; 124/1, 3, 16, 29

(56) References Cited

U.S. PATENT DOCUMENTS

| | | | | |
|---|---|---|---|---|
| 1,489,191 A | | 4/1924 | Chester | |
| 1,547,834 A | | 7/1925 | Smookler | |
| 2,111,952 A | | 3/1938 | Tratsch | |
| 3,191,588 A | | 6/1965 | Thew | |
| 3,515,114 A | | 6/1970 | Carbonneau | |
| 3,845,957 A | | 11/1974 | Lohr et al. | |
| 4,225,140 A | | 9/1980 | D'Andrade et al. | |
| 4,744,566 A | * | 5/1988 | Malavazos et al. | 273/357 |
| 4,759,551 A | | 7/1988 | Crompton | |
| 4,844,464 A | * | 7/1989 | Berge | 463/27 |
| 4,910,646 A | | 3/1990 | Kim | |
| 5,016,880 A | * | 5/1991 | Berge | 463/27 |
| 5,224,860 A | | 7/1993 | Waldman et al. | |

(List continued on next page.)

FOREIGN PATENT DOCUMENTS

| | | |
|---|---|---|
| JP | 9-14764 | 1/1934 |
| JP | 01-291887 | 11/1989 |
| JP | 5-68577 | 9/1993 |
| JP | 07-181934 | 7/1995 |
| JP | 08-299585 | 11/1996 |
| JP | 09-075552 | 3/1997 |
| JP | 9-140941 | 6/1997 |
| JP | 09192353 | 7/1997 |
| JP | 09-239151 | 9/1997 |
| JP | 9-271582 | 10/1997 |
| JP | 9-271583 | 10/1997 |
| JP | 10-230081 | 9/1998 |
| JP | 11-047432 | 2/1999 |
| JP | 11-047433 | 2/1999 |
| JP | 11-146977 | 6/1999 |
| JP | 00-233066 | 8/2000 |
| JP | 2001-353354 | 12/2001 |

OTHER PUBLICATIONS

Fire Control Systems Kollsman, Inc. www.army–technology.com/–contractors/fire/kollsman.

Feb. 1, 1999 Syphon Filter Instruction Manual 989 Studios, Inc.

*Primary Examiner*—John M. Hotaling, II
*Assistant Examiner*—Scott Jones
(74) *Attorney, Agent, or Firm*—Jordan and Hamburg LLP

(57) ABSTRACT

A shooting game machine includes a target unit in which targets are arranged at four stages. A token discharge device faces the target unit and is operable by a game player to discharge a token while selectively aiming at any of the plurality of targets. Display units are provided in correspondence with the respective targets for displaying scores corresponding to the targets, and a target processor sets the scores to be displayed on the display units. A jackpot appearing position/time determining processor sets a special high score on one of the display units which is selectively changed over time. Impact sensor units detect when the token hits the corresponding target, and a dispenser pays tickets out to the game player corresponding to the score on the display unit corresponding to the hit target.

6 Claims, 16 Drawing Sheets

U.S. PATENT DOCUMENTS 5,326,108 A 7/1994 Faith
5,417,435 A * 5/1995 Peretz ..... 273/355
5,445,138 A 8/1995 Faith
5,460,384 A 10/1995 Seidel et al.
5,613,482 A 3/1997 Thai et al.
5,669,607 A 9/1997 Silver et al.
5,888,115 A * 3/1999 Shoemaker et al. ..... 446/168
6,095,519 A * 8/2000 Shoemaker, Jr. ..... 273/119 R
6,144,375 A 11/2000 Jain et al.
6,568,380 B1 * 5/2003 Niwa et al. ..... 124/16

* cited by examiner

SHOOTING GAME MACHINE AND SHOOTING GAME SYSTEM

BACKGROUND OF THE INVENTION

The present invention relates to a shooting game machine which is installed in a position facing a plurality of targets, that causes a game medium, such as a token, to be propelled while being aimed at any desired one of the plurality of targets, and gives a game player a valuable corresponding to a score set for the hit target, and to a shooting game system.

A medal game machine is known which is installed in a position facing a plurality of targets, that causes a token to be propelled while being aimed at any desired one of the plurality of targets, and which gives a game player a credit corresponding to a score set for the hit target. Some machines of this type are designed for a single player, and others are designed for multiple players. In the case of the machines for a single player, a score is cumulatively displayed in a jackpot upon insertion of a token, or a part of scores usually obtained upon hitting a target is accumulatively displayed therein as contribution points. The game player's desire to improve his skill is stimulated by enabling him to gain the accumulated points when a special spot set at one of the targets is hit thereafter. In the case of the machines for multiple players, the respective contribution points from a plurality of machines are centrally accumulated as jackpot points and, when a special spot is hit in any of these plurality of machines, all accumulated points are paid off to a player playing with this machine.

In the conventional medal game machines with a jackpot, players generally aim at the special spot for which the jackpot is set, and the meaning of existence of the other targets, i.e., targets for which low scores are set, is relatively weak. The players tend to challenge the special spot, whereas they tend to unnecessarily lose tokens since the special spot, i.e., the jackpot spot, is set at a position difficult to aim at, and to therefore, hit. Furthermore, although the game player's desire to shoot can be incited to gain the accumulated points when sufficient points are accommodated for the jackpot, the jackpot has little attraction, and the game player's interest is low while sufficient points have not yet been accumulated. Thus, the game player's interest in the game is markedly different depending on whether sufficient points have been accumulated or not.

SUMMARY OF THE INVENTION

In view of the above problems residing in the prior art, an object of the present invention is to provide a shooting game machine in which a specified jackpot value is set and a target corresponding to a jackpot is changed among a plurality of targets over time, thereby causing a game player's interest in a game to differ to a lesser degree, thereby stabilizing his desire to shoot.

In order to achieve the above object, a shooting game machine according to the present invention, comprises a target unit including a plurality of targets, a shooting unit provided at a position facing the target unit and operable by a game player to cause a game medium to fly while selectively aiming at any of the plurality of targets, display units provided in correspondence with the respective targets for displaying values corresponding to the targets by codes, value setting means for setting the values to be displayed on the display units, jackpot setting means for setting a jackpot value on one of the display units selectively changed over time, hit detecting means for detecting the hit of the game medium at the target, and a dispenser for paying out a material corresponding to the value displayed on the display unit corresponding to the hit target when the game medium hits one target.

With this construction, the game player can cause the game medium to be propelled by operating the discharging unit while aiming at a specific one of the plurality of targets arranged in front. When the aimed target or an other target is hit by the game medium, the value, for example, a specified score, displayed in correspondence with the hit target, can be obtained, and the corresponding valued material is paid out from the dispenser. When the target corresponding to the jackpot is hit, the jackpot value, for example, a special high score, can be obtained, thereby making the game player's interest in a game vary only to a small degree, thereby urging the game player to have a desire to shoot better.

These and other objects, features and advantages of the present invention will become more apparent upon a reading of the following detailed description and accompanying drawings.

DETAILED DESCRIPTION OF THE PREFERRED EMBODIMENTS

Figure 1:
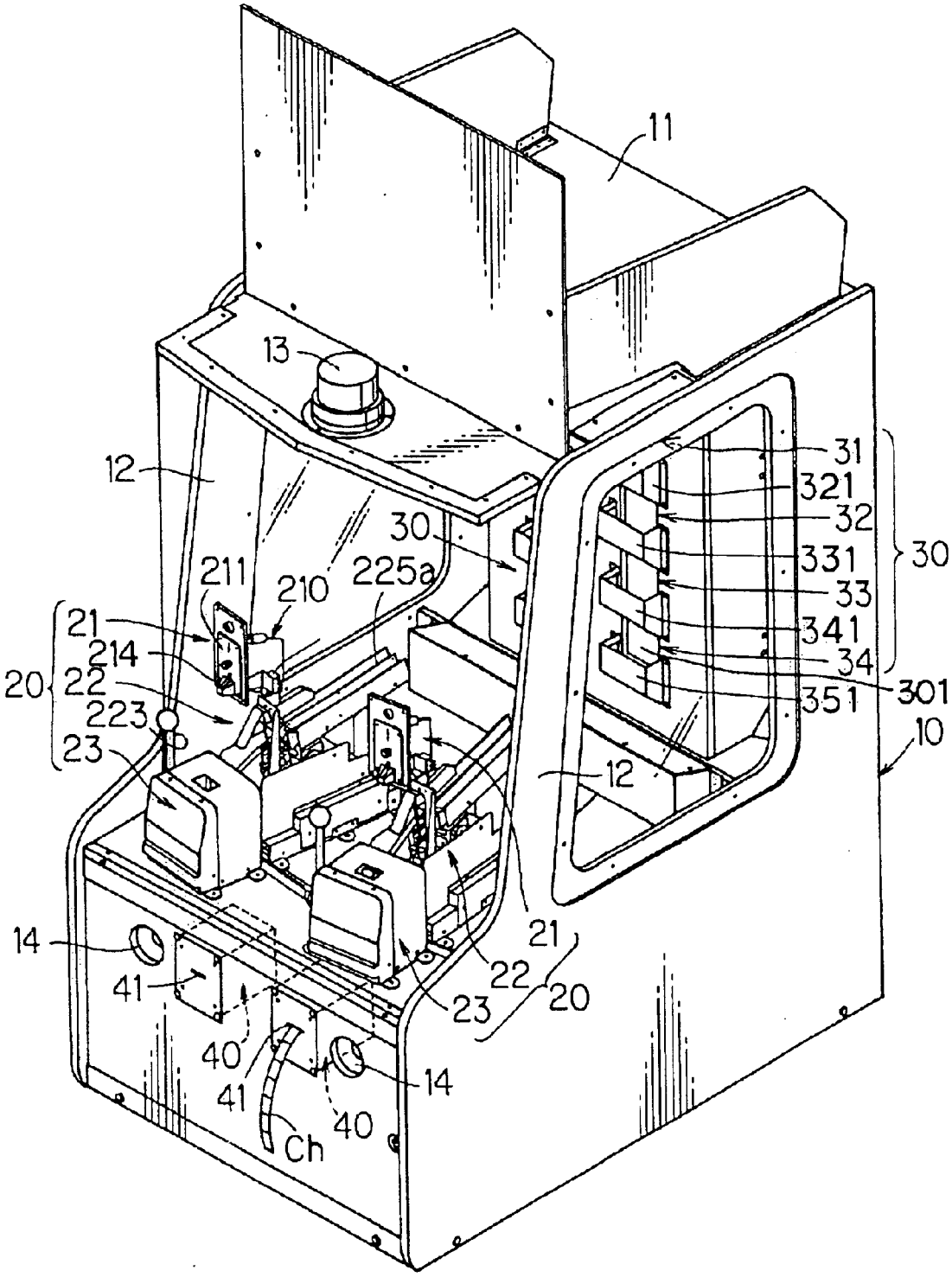
FIG. 1 is a perspective view showing the external configuration of a shooting game machine according to one embodiment of the invention.
Figure 2:
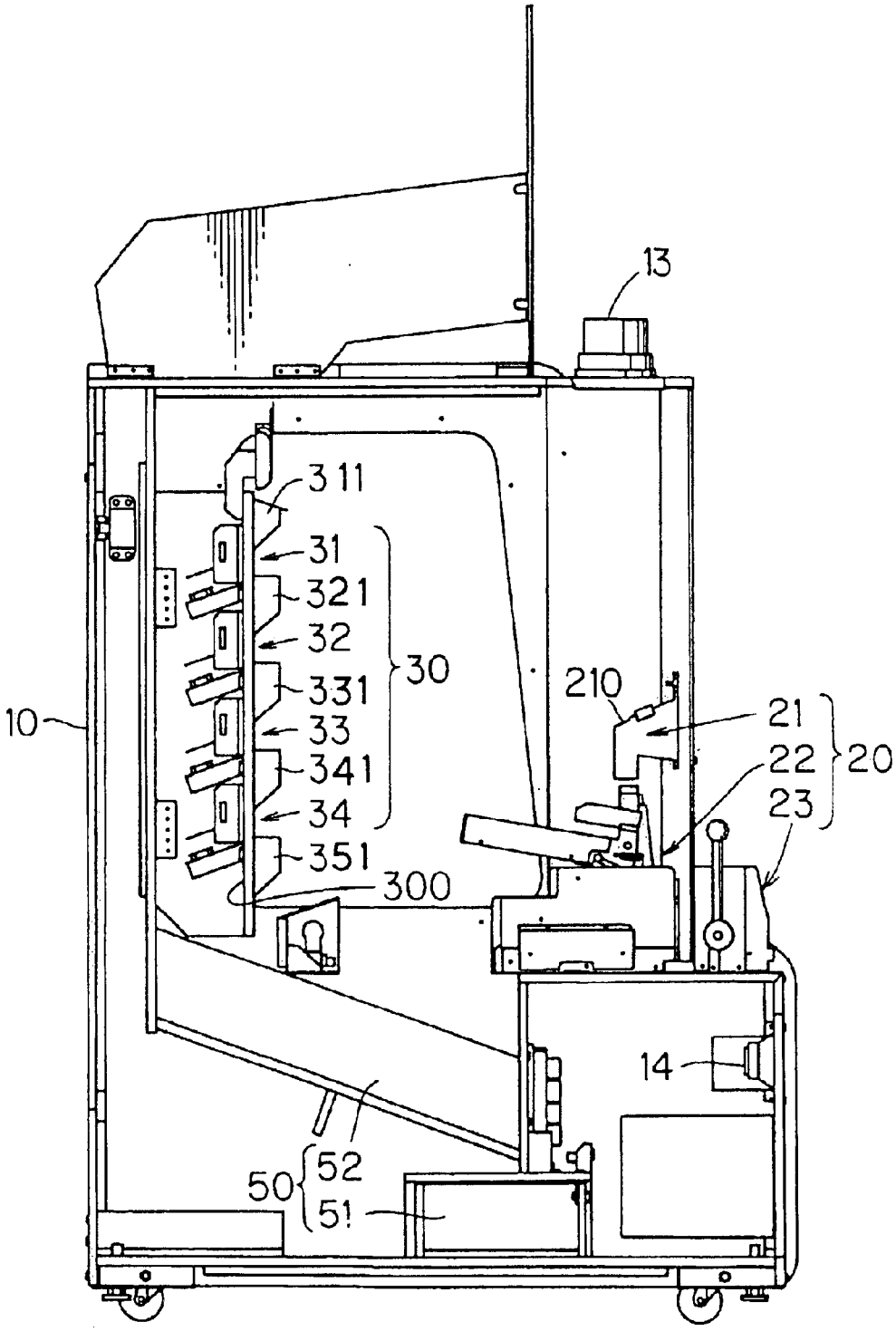
FIG. 2 is a side view of the shooting game machine of FIG. 1.
Figure 3:
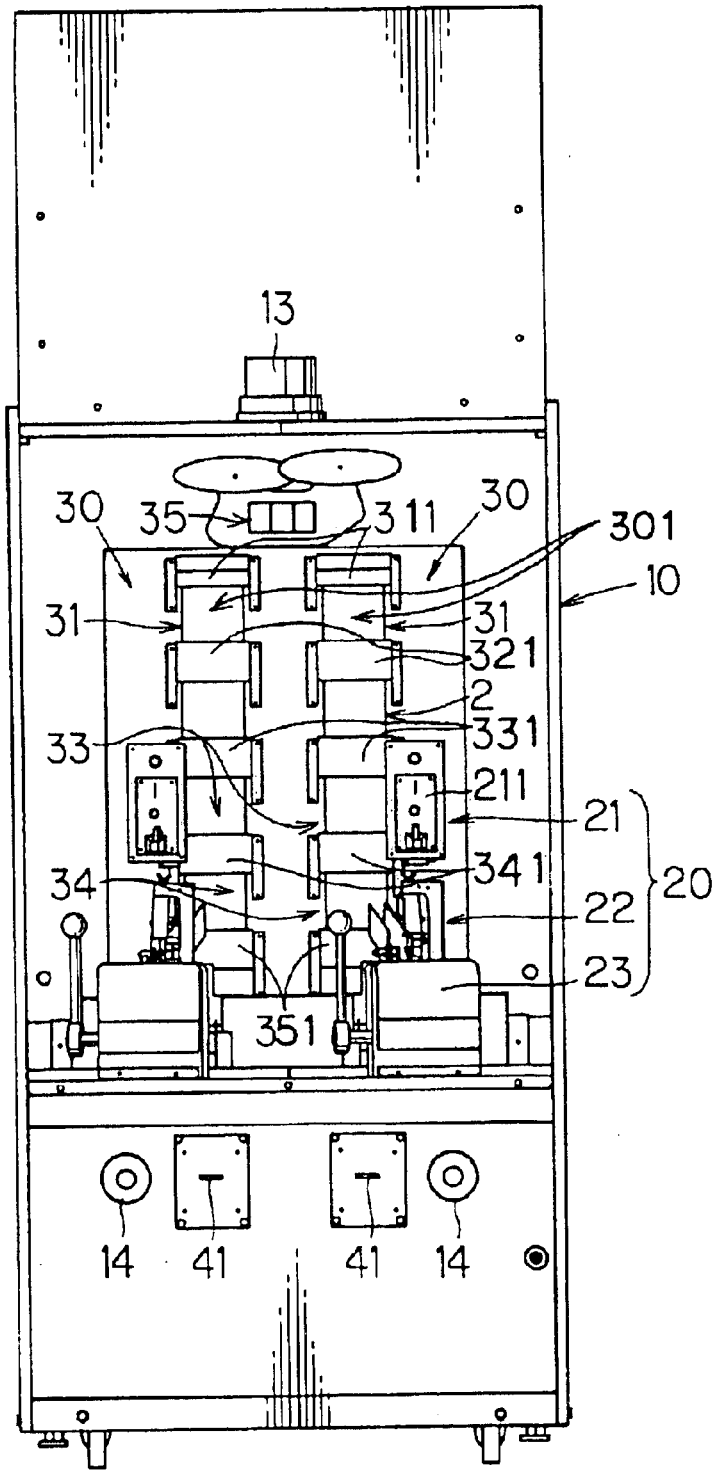
FIG. 3 is a front view of the shooting game machine of FIG. 1.

FIG. 1 is a perspective view showing the external configuration of a shooting game machine according to one embodiment of the invention, FIG. 2 is a side view of the shooting game machine, and FIG. 3 is a front view of the shooting game machine.

As shown in FIGS. 1 to 3, the shooting game machine has a casing 10 comprised of a portion forming a gaming plane and a projecting back portion projecting upward behind the game-surface forming portion. This shooting game machine is constructed as a dual-player machine by providing two token discharge units 20 as shooting devices for causing game mediums such as tokens to be propelled at the left and right sides of the front side of the casing 10 and providing two target units 30 at the left and right sides of the projecting back portion. Two dispensers 40 are provided side by side at the front surface of the casing 10 for the respective game players. The respective token discharge units 20, the target units 30 and the dispensers 40 have identical constructions. Inside the casing 10 are provided a token collecting unit 50 as shown in FIG. 2 and a control unit (not shown) for controlling the progress of a shooting game. As shown in FIG. 2, this game machine is so designed that the target units 30 are reminiscent of windows of a building and the token discharge units 20 are reminiscent of fire engines.

The casing 10 has a ceiling portion 11 and window portions 12 at its left and right sides in which transparent resin plates are fitted so as to surround the gaming plane. A revolving light 13 as an electric decoration and loudspeakers 14 for acoustics are provided on the ceiling portion and at the left and right sides of the front wall surface, respectively.

Figure 4:
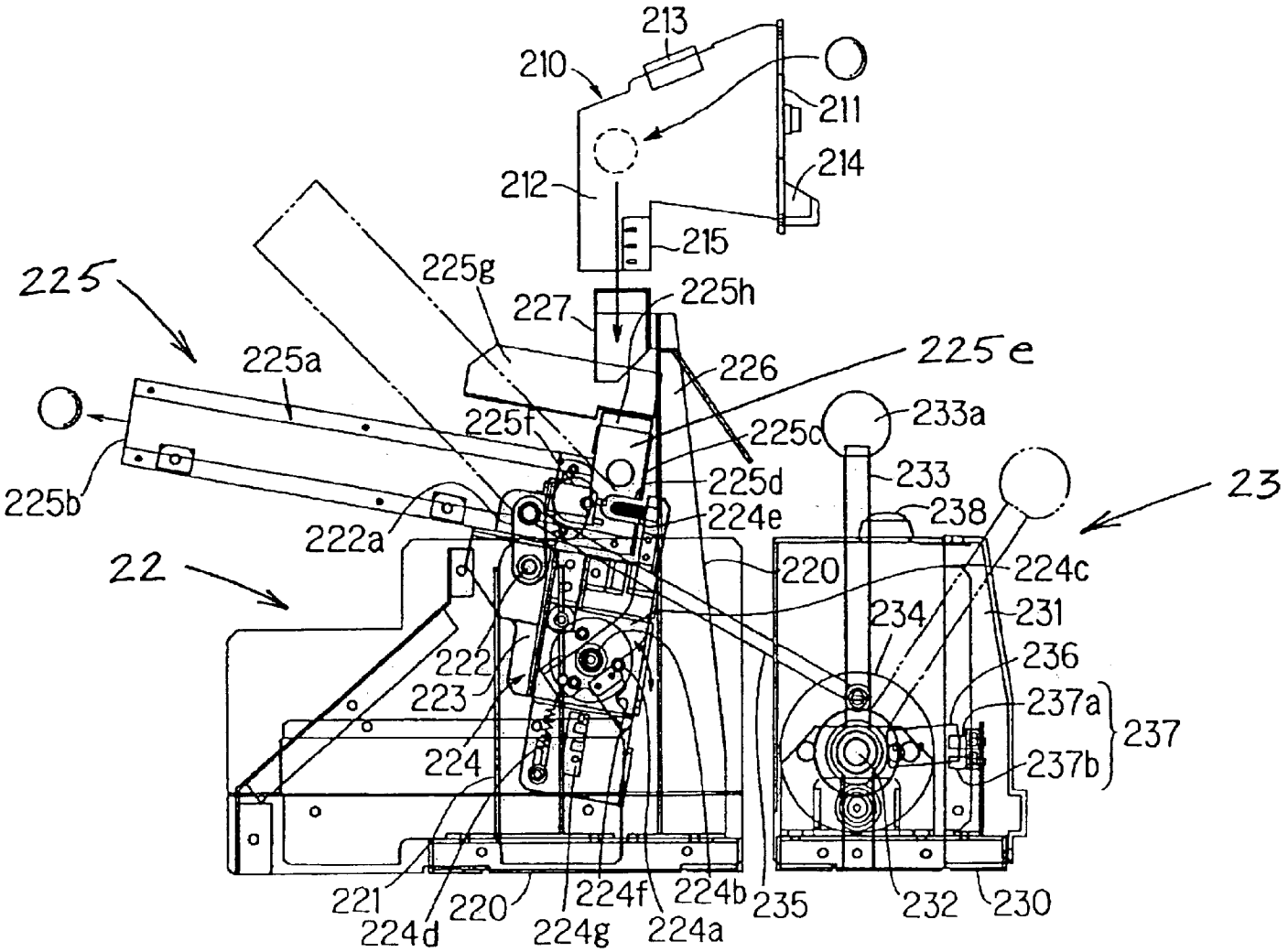
FIG. 4 is a detailed construction diagram of a token discharging device.

Each token discharge unit 20 is comprised of a token inserting device 21, a discharging device 22 and a discharge maneuvering device 23. Hereinafter, the token discharge unit 20 is described with reference to a detailed construction diagram of FIG. 4.

The token discharge unit 20 is such that the token inserting device 21 is provided atop the discharging device 22, and the discharge maneuvering device 23 is provided behind, i.e., at the side of the discharging device 22 toward the game player. The token inserting device 21 is comprised of a slot 211 having such a width as to enable insertion of a vertically oriented token, and a token guiding portion 210 formed with a passage 212 communicating with the slot 211, extending downward and defined by narrowly spaced opposing wall surfaces for guiding the inserted token downwardly. A genuineness detector 213 for detecting the genuineness of the inserted token is built in an intermediate position of the passage 212 of the token guiding portion 210, and a mechanism (not shown) for discharging objects other than tokens, to be used to a return opening 214, is provided. A token detector 215 is provided in the passage 212 for detecting the presence or absence of the token having passed the genuineness detector 213, i.e., after insertion of the proper token.

The discharging device 22 includes a pair of frames 221 standing on the left and right sides (spaced apart in the depth direction of FIG. 4) of a base board 220 mounted on the gaming plane, a shaft 222 rotatably mounted about a horizontal axis at upper parts of the frames 221, a frame 223 rotatable together with the shaft 222, and upper and lower discharging mechanisms 224, 225 supported on the frame 223.

The discharging mechanism 224 includes a rotary solenoid 224*a* rotatable about a horizontal axis extending transverse direction, and a rod-shaped trigger (hammer) 224*c* is so secured near the bottom end of a rotary shaft 224*b* of the rotary solenoid 224*a* so as to be rotatable together therewith. The hammer 224*c* is biased in a direction toward the shooting position (counterclockwise direction in FIG. 4; reverse rotating direction) by a spring 224*d* mounted between the bottom end thereof and the frame 221. A specified shooting force is obtained by biasing forces of the rotary solenoid 224*a* and the spring 224*d*. A hitting member 224*e* having a specified length and formed by an elastic member, such as a coil spring, is mounted on the upper end of the hammer 224*c* in such a manner as to circumferentially project when viewed from the rotary shaft 224*b*. The rotary solenoid 224*a* can be driven in forward and reverse rotating directions by supplying a drive voltage and a rotating direction signal. Thus, the hammer 224*c* can be actively driven both at the time of shooting (reverse rotation) and at the time of returning to a pulled position (forward rotation) and, particularly, a hitting force at the time of shooting by means of the hitting member 224*e* is secured. It should be noted that the spring 224*d* is adapted to stably bold the hammer 224*c* in the shooting position during suspension, during which power application to the rotary solenoid 224*a* is suspended.

A detection piece 224*f* projects in a vicinity of the bottom end of the hammer 224*c*, and the frame 221 is mounted with a hammer sensor 224*g*, such as, for example, a photointerrupter, for detecting this detection piece 224*f* when the hammer 224*c* is returned to pulled position by the rotary solenoid 224*a*. The hammer sensor 224*g* may be a non-contacting type sensor, such as, for example, an optical sensor and a magnetic sensor, or may be a mechanical contacting type sensor.

A discharging pad 225*f* is provided with a gunbarrel 225*a* having an elongated tubular body oriented forward, toward the target unit 30. Inner walls of the gunbarrel 225*a* are so dimensioned as to define an inner space having a width and a height slightly larger than the width and diameter of the vertically oriented token, so that the shot token smoothly passes through the inside of the gunbarrel 225*a* and flies out at a specified speed, i.e., at a speed sufficient to at least reach the uppermost part of the target unit 30 from a muzzle 225*b* at the leading end.

A base end 225*c* of the gunbarrel 225*a* defines a shooting position. A notch 225*d* extending in longitudinal direction and having a specified width and a specified length is formed in the base end 225*c*. The notch 225*d* is so shaped as to permit entrance of the hitting member 224*e* provided at the leading end of the hammer 224*c*. The base end 225*c* of the gunbarrel 225*a* is bent upward, and is continuous with a token standby portion 225*e* having a communication path communicating an upper end opening of the base end 225*c*, and a token passage in the gunbarrel 225*a* is continuous with the base end 225*c*.

A token locker 225*f* for enabling projection of a restricting pin for preventing the token set at the shooting position from rolling toward the muzzle 225*b* at a token passage surface is provided at a side wall immediately downstream from the shooting position where the base end 225*c* of the gunbarrel 225*a* is located. The token locker 225*f* is formed of an electromagnetic solenoid or the like which restricts a rolling movement of the token set at the shooting position by causing the restricting pin to appear in the token passage and retracted into the side wall upon receipt of a shooting instruction, to be described later.

The frame 223 is prevented from rotating any further in the returning direction at the pulled position by a stopper (not shown), and the gunbarrel 225*a* is set such that the muzzle 225*b* and the base end 225*c* are located substantially on a horizontal plane, or the former is slightly higher than the latter. However, if the token locker 225*f* is suitably adapted, the former may be located slightly lower than the latter.

A token hopper 225*g* is provided in a position facing an upper end opening of the token standby portion 225*e*. Further, a projecting piece 226 stands at the left or right side behind (right side in FIG. 4) the base board 220, i.e., at a position not interfering with the discharging mechanism 224 and the discharging pad 225. An intermediate guiding portion 227 for transferring tokens from the token guiding portion 210 to the token hopper 225*g* is mounted above the projecting piece 226. The intermediate guiding portion 227 is arranged such that its receiving opening faces a downstream end opening of the token guiding portion 210, and a path for the passage of the token is so formed as to communicate with the receiving opening, and its bottom end is open. The upper surface of the token hopper 225*a* is entirely open and the side surfaces thereof are surrounded by walls for preventing the token from falling. Further, an opening 225*h* having such a size as to permit the passage of the token is formed at the rear end of the bottom surface of the token hopper 225*g*. A mounting angle of the token hopper 225*g* is set in advance such that its rear end is constantly located lower than its front end within a rotatable range of a shaft 222. Thus, the token from the intermediate guiding portion 227 never fails to fall onto the token standby portion 225*e* through the opening 225 at the rear end. By forming the token hopper 225*g* in this way, the token from the token guiding portion 210 can be always received by the opening in the upper surface of the token hopper 225*g*, even if a relative position of the token hopper 225*g* and the token guiding portion 210 is displaced by changing a discharging angle of the discharging pad 225, as described later.

The discharge maneuvering device 23 (as also identified and shown in FIG. 1) is provided before (right side in FIG. 4) the discharging device 22, and a lid-shaped casing 231 substantially in the form of a rectangular parallelepiped, is mounted on the base board 230 mounted on the gaming plane. A shaft 232 rotatable about a horizontal axis is mounted between the left and right walls of the casing 231. One of the left and right sides of the shaft 232 is extended, and an operation lever 233 extending radially of the axis of the shaft 232 is mounted at the leading end of the extended portion of the shaft 232. The operation lever 233 has a specified length suited to be rotated by the game player, and a grip 233*a* is mounted at the top thereof.

A large-diameter member 234 radially extending from the axis of the shaft 232 is mounted in a specified position of the shaft 232 with respect to its longitudinal direction in such a manner as to be rotatable with the shaft 232. At a position of the shaft 222 of the discharging device 22 in alignment with the large-diameter member 234 in transverse direction (depth direction in FIG. 4), a large-diameter member 222*a* is so mounted as to be rotatable with the shaft 222. A coupling bar 235 is mounted between a position of the large-diameter member 234 displaced from the shaft 232 and located in the extending direction of the operation lever 233 and a specified position of the large-diameter member 222*a* displaced from the shaft 222. The coupling bar 235 is so mounted as to be rotatable with respect to the large-diameter members 234 and 222*a*. A relationship of the mount positions of the coupling bar 235 and the large-diameter members 234 and 222*a* is such that the discharging pad 225 is returned to the pulled position with the operation lever 233 inclined by, for example, 15 (toward the game player, so that the game player's hand gripping the grip 233*a* does not contact a front glass or the like. If there is no such particular problem, the discharging pad 225 may be returned to the pulled position when the operation lever 233 is located at a position directly above.

Accordingly, if the game player rotates the operation lever 233 to pull it toward himself, the gunbarrel 225*a* is faced upward according to the rotation amount of the operation lever 233.

A radially extending detection piece 236 is secured to the shaft 232 so as to be rotatable therewith, and a discharging direction sensor 237 comprised of two photointerrupters 237*a*, 237*b* for detecting a discharging angle is provided on a trajectory of rotation of the detection piece 236. Four rotation positions with respect to the detection pieces 236 can be detected as shown in FIG. 5. A discharge button 238 is provided on the upper surface of the casing 231.

Figure 5A:
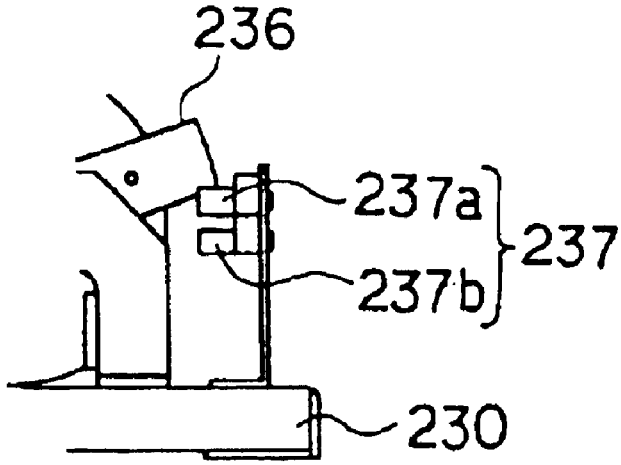
FIGS. 5A to 5D are diagrams showing four detectable angular positions of a detection piece.
Figure 5B:
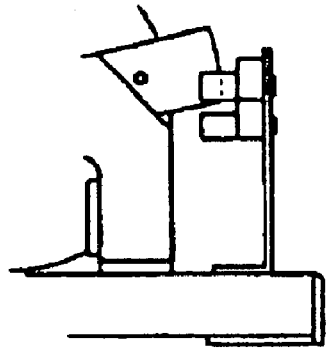
Figure 5C:
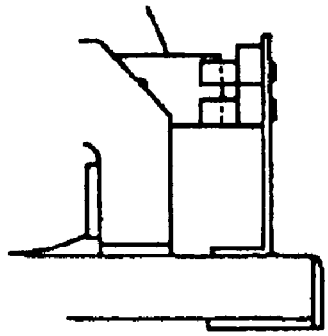
Figure 5D:
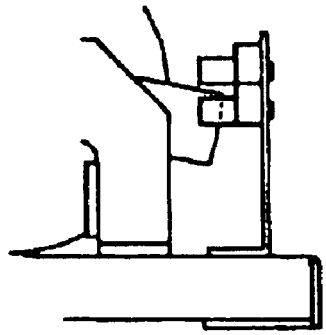

FIG. 5A shows a state where the outputs of the photointerrupters 237*a*, 237*b* are both HIGH and the discharging pad 225 is aimed at a target of the target unit 30 at the bottommost one of four stages to be described later. FIG. 5B shows a state where the output of the photointerrupter 237*a* is LOW, the output of the photointerrupter 237*b* is HIGH, and the discharging pad 225 is aimed at a target of the target unit 30 at the second lowest stage. FIG. 5C shows a state where the outputs of the photointerrupters 237*a*, 237*b* are both LOW, and the discharging pad 225 is aimed at a target of the target unit 30 at the second highest stage. FIG. 5D shows a state where the output of the photointerrupter 237*a* is HIGH, the output of the photointerrupter 237*b* is LOW, and the discharging pad 225 is aimed at a target of the target unit 30 at the uppermost stage. The detected state of the discharging direction sensor 237 and the target actually hit by the token are set in advance to coincide based on, for example, a speed of the rotary solenoid during reverse rotation and other factors. The target units 30 are constructed for the dual-player game machine as described above, and two target units 30 having an identical construction are arranged side by side in transverse direction. The target units 30 are provided on a board 300 standing at a position between the token discharge device 20 and the game board surface. In addition, four targets 31, 32, 33 and 34 are vertically arranged at specified intervals from the above. The constructions of the respective targets are described later. In the following description, these targets 31, 32, 33 and 34 are merely referred to as targets, except those at the specific stages which are mentioned.

The dispenser 40 pays tickets Ch, such as, for example, credits, out to a dispensing opening 41 and is internally provided with a dispensing mechanism. A known construction may be adapted for the dispensing mechanism. For example, a multitude of perforated credits connected in series and rolled up is mounted inside, and the credits are successively dispensed from the leading end from the dispensing opening 41 while being held between a pair of dispense rollers rotation-controlled by a drive motor and having their length detected one by one. An other known construction may also be adopted. As described later, when a plurality of tickets Ch are paid out, they may be done so by counting a necessary number using a dispensing counter. Alternatively, a total length of the plurality of tickets Ch to be paid out may be calculated in advance and a control may be executed to dispense the tickets corresponding to the calculated total length at once.

The length of one ticket Ch can be detected by measuring a rotation amount of the dispense rollers using a rotary encoder, and the number of tickets can be counted by detecting marks or the like affixed to specified positions of the tickets by means of an optical sensor. Further, a situation in which the tickets have been run out can be known by setting an initial value when the rolled tickets are mounted and by decreasing the initial value one by one every time the ticket is dispensed, or by detecting the absence of the ticket by means of an optical sensor provided at a dispensing end.

The token collecting mechanism 50 is provided with a collecting box 51 for collecting the tokens after having directly fallen onto the game board surface and having hit the targets, and a collecting guide 52 comprised of a hopper and a collecting path, the hopper extending from the token discharge devices 20 to the rear (back) side of the board 300 of the target units 30, having an area extending in forward and backward directions and transverse direction to cover the entire game board surface, and being sloped downward toward the front below the game board surface.

Figure 6:
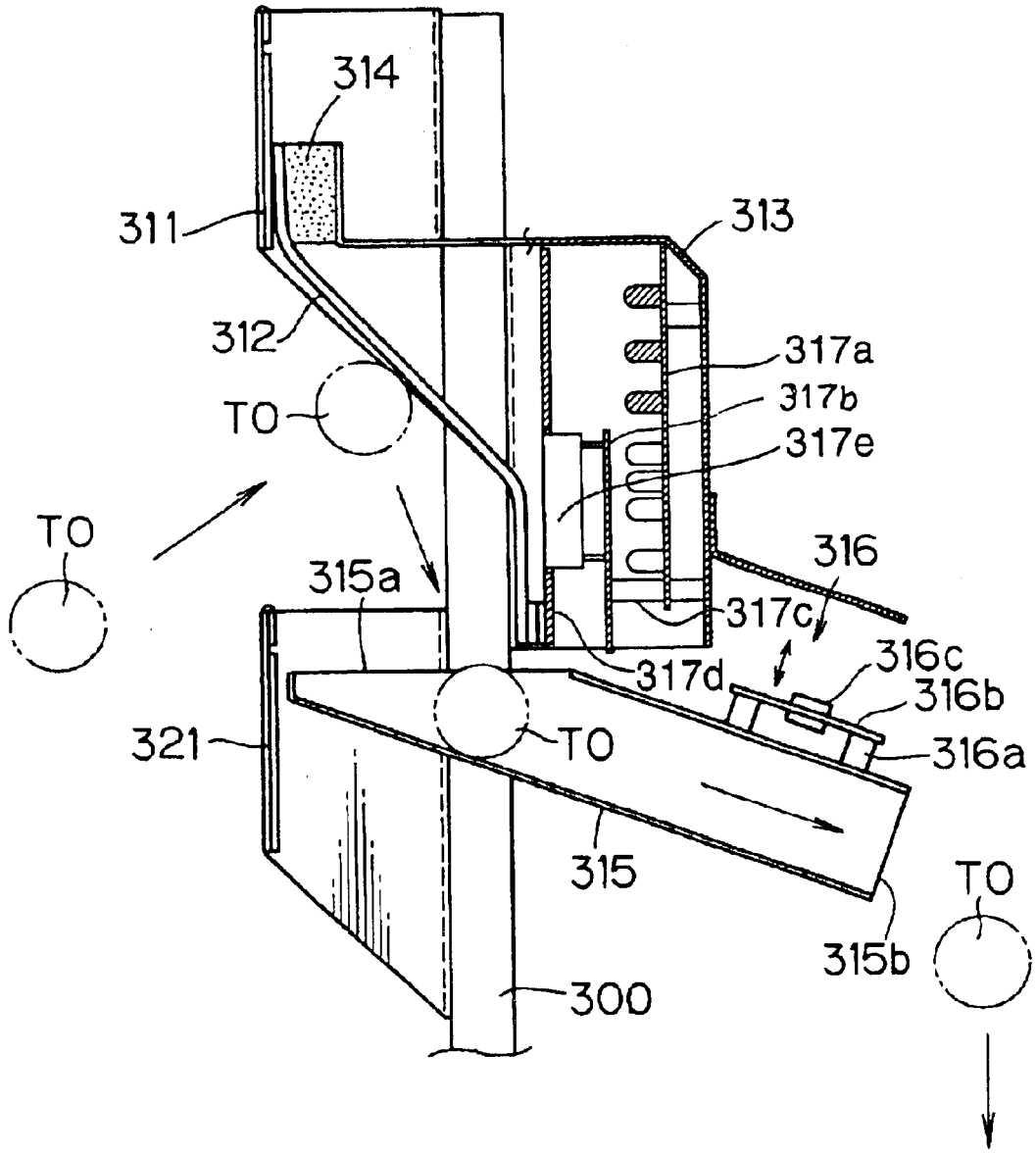
FIG. 6 is a die view showing a structure of a target.
Figure 7B:
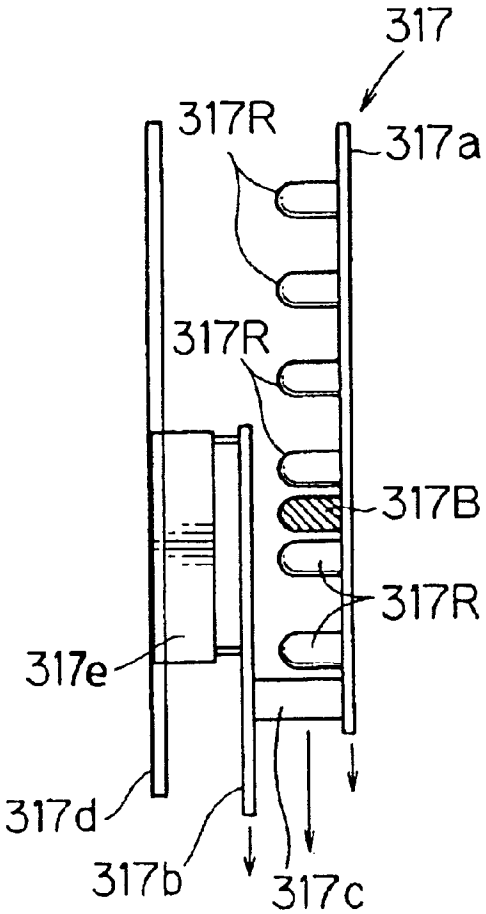
FIGS. 7A, 7B, and 7C are a front view, a side view, and a perspective view showing the construction of a display unit and a presentation display unit.
Figure 7A:
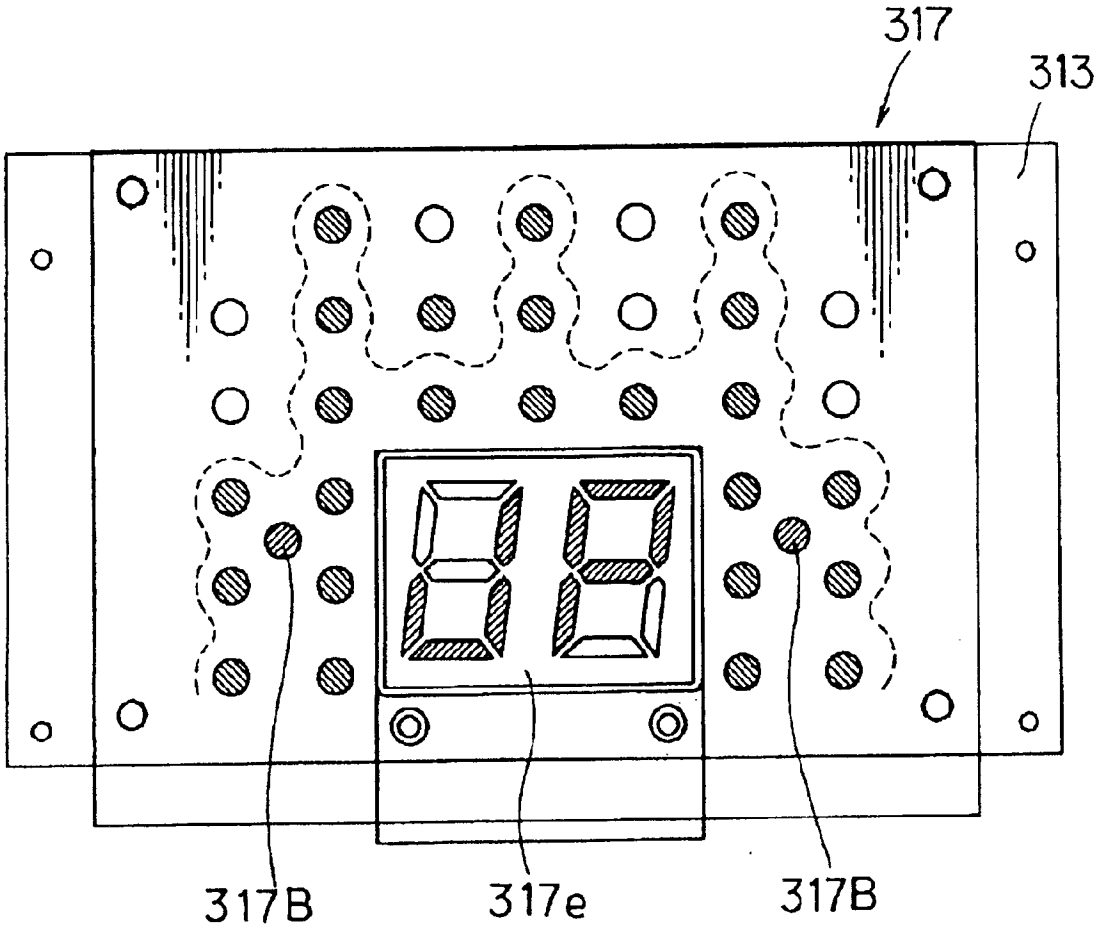
Figure 7C:
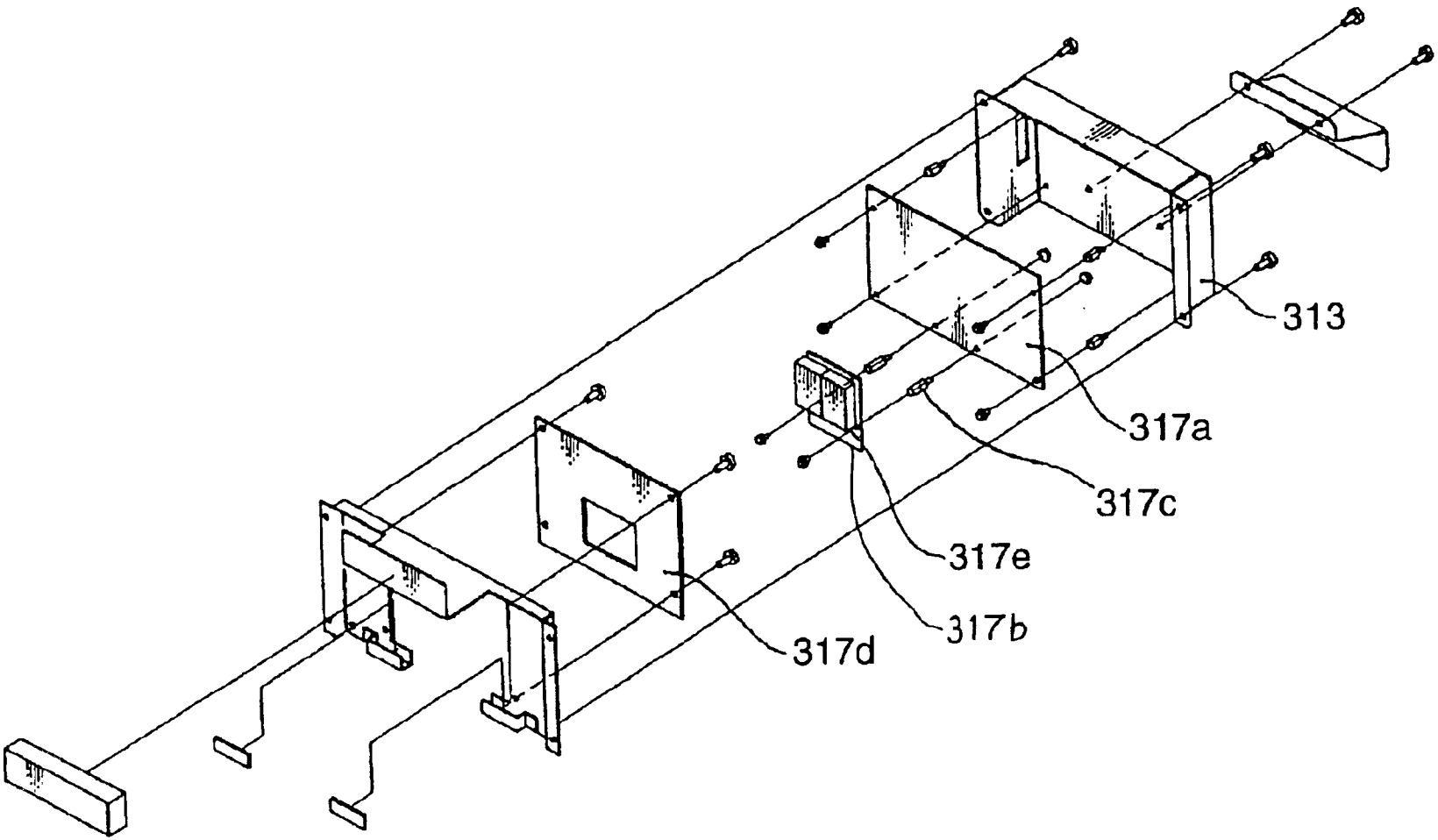

FIG. 6 is a side view showing a structure of a target, and FIGS. 7A, 7B, and 7C are a front view, a side view, and a perspective view, respectively, showing the construction of a display unit and a presentation display unit.

As shown in FIGS. 1 and 3, two vertically elongated openings 301 are formed side by side in the transverse direction in the board 300, and baffle plates 311, 321, 331, 341, 351 having a U-shaped cross section are vertically arranged at specified intervals from above on the front surface of the board 300. Since the targets 31 to 34 are basically identically shaped, the target 31 is representatively described below. Further, as shown in FIG. 3, a picture simulating a helicopter is drawn at the top of the board 300, and a jackpot score display unit 35 provided with three numerical value display units formed of 7-segment LEDs is provided in this picture.

The target 31 is formed between the baffle plates 311 and 321. The baffle plate 311 has an upright front portion spaced apart from the opening 301 at least by the diameter of the token and covering the opening 301. A transparent contact plate 312 extends obliquely downward to the back from the bottom end of the upright front portion. An angle of inclination of the contact plate 312 is set such that the discharge token securely falls toward the opening 301 after hitting the contact plate 312. A mounting cover 312 is mounted on the board 300 at a position of the opening 301 right behind the target 31. A display unit shown in FIGS. 7A–7C is mounted on this mounting cover 313. The mounting cover 313 is mounted such that a specified wide clearance width is defined between an upper part thereof and the rear surface of the baffle plate 311, and a specified narrow clearance is defined between a bottom part thereof and the rear surface of the board 300. The contact plate 312 is mounted by fitting the upper and bottom parts thereof into these two clearances. For example, a sponge 314 as a cushioning member is mounted in the upper clearance, whereas the lower clearance is left as it is. An impact force given by the hit token is absorbed and alleviated by such a semi fixed supporting construction.

A duct 315 having an end corresponding to the width of the opening 301 and adapted to collect the hit tokens is provided at a position below the contact plate 312 and concealed by the baffle plate 321 located directly below. The duct 315 has an opening 315*a* formed in the upper surface of its leading end so as to securely collect the falling tokens. The duct 315 is sloped downward from its leading end to its downstream end, so that the collected token can be guided to the downward side by the action of gravity, caused to fall onto the collecting guide 52 through a downstream side opening 315*b*, and finally collected into the collecting box 51.

An impact sensor device 316 is mounted at a specified position of a wall surface of the duct (an upper surface in this embodiment) between its leading end and its downstream end. The impact sensor device 316 is constructed such that a sensor 316*c* is mounted on a substrate 316*b* provided on the wall of the duct 315 via a spacer 316*a*. The sensor 316*c* is an impact detecting device formed by, for example, a piezoelectric device, and is adapted to detect an impact when the token having hit the contact plate 312 falls onto the duct 315. The impact sensor device 316 is constructed as above in order to avoid an erroneous detection of an impact by the token having hit the baffle plate 311 or 312, or the board 300, i.e., having missed the target. In order to prevent such an erroneous detection, the baffle plate 321 and the duct 315 are mounted on the board 300 and the like using vibration-proof nuts. An impact caused only by the token having fallen onto the duct 315 can be securely detected by providing a filtering circuit for extracting only a natural frequency of the mounted duct 315 by causing only detection signals from the sensor 316 having such a frequency component to pass.

The display unit 317 is secured to the mounting cover 313 by screws, and a first substrate 317*a* and a second substrate 317*b* are arranged one over the other via a spacer 317*c*. The first substrate 317*a* functions as a flame presenting display unit and includes, for example, a multitude of red LEDs 317R as right point light sources. In this embodiment, two blue LEDs 317B as blue point light sources are also mounted in transversely symmetrical positions. In this embodiment, the red LEDs 317R are dispersedly arranged to present a flame, and the blue LEDs 317B are turned on to notify a jackpot. A resin plate 317*d* is formed of an acrylic plate which is provided above the second substrate 317*b* while being spaced apart therefrom by a specified distance, and formed with a rectangular notch at a lower part of its middle portion. Preferably, a resin plate having a light diffusing function is adopted. The light diffusing function may be given by surface processing or applying an opacifying agent or by adopting a plate member in which an opacifying agent is mixed.

A two-digit display unit 317*e* in which two numerical value display units formed of 7-segment LEDs are horizontally provided side by side is located in a position substantially in the center (slightly displaced toward the bottom end in this embodiment) of the target 31 while being mounted on the second substrate 317*b* and fitted into the notch of the resin plate 317*d*. The number of the digits of the display unit 317*e* is determined in relation to scores to be set. Three digits (or one digit) may be provided if score of three digits (or one digit) are adopted. FIG. 7A shows an example in which "JP" standing for jackpot, and meaning a special high score, is displayed.

Figure 8:
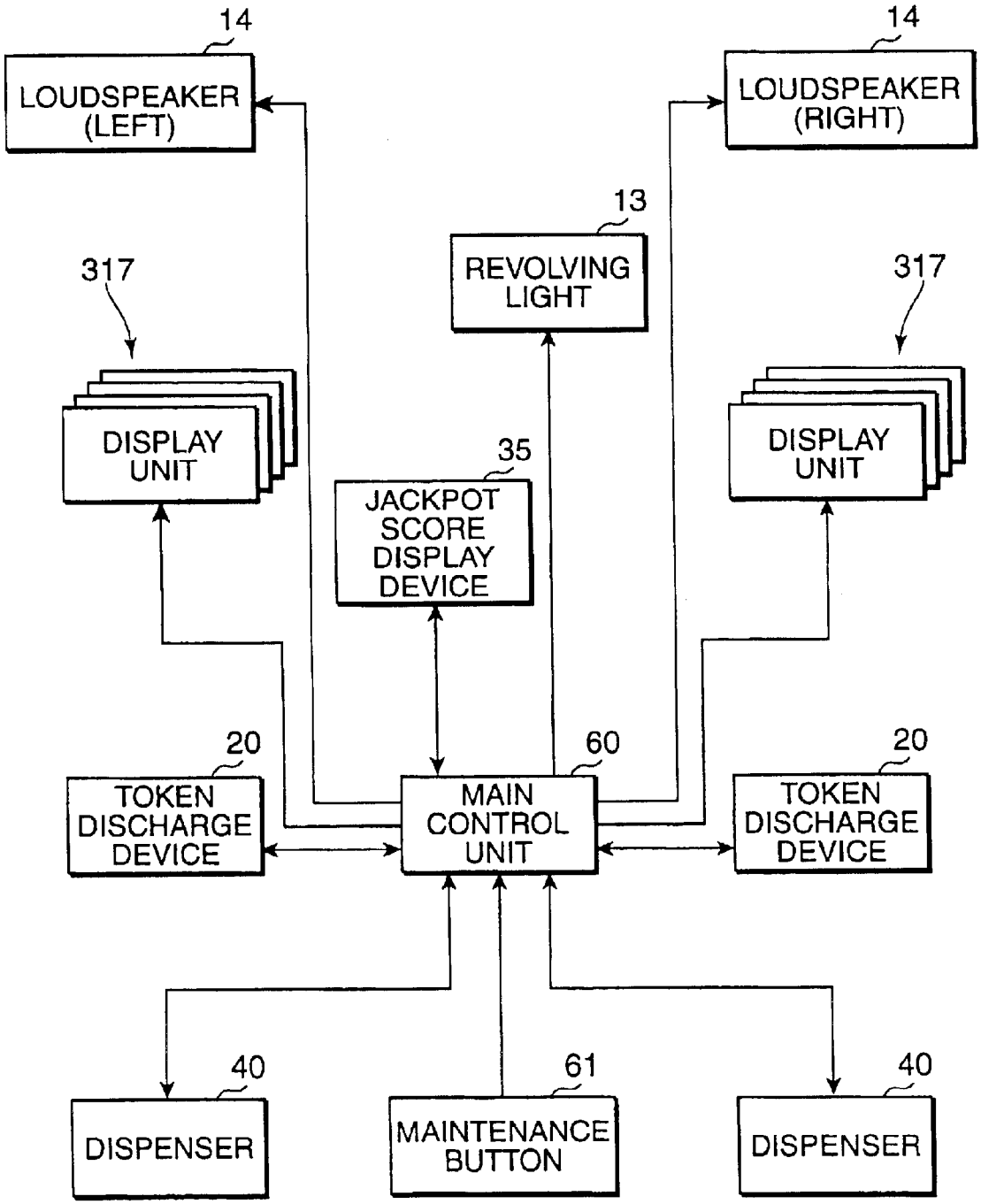
FIG. 8 is a block construction diagram of the shooting game machine.

FIG. 8 is a block construction diagram of this shooting game machine. This shooting game machine is provided with a main control unit 60 having a built-in CPU, and the operations of the respective elements are controlled by connecting the token discharge devices 20, the target units 30, the dispensers 40, the loudspeakers 14, the revolving light 13, the jackpot score display unit 35 and a maintenance button 61 with the main control unit 60. The maintenance button 61 is operated to give an instruction to temporarily suspend a dispensing processing to secure a time for maintenance in the case that an operation abnormality occurs in the dispensers 40 or the like. The maintenance button 61 is provided in a specified position of an outer surface of the dispenser 40 lest the game player should inadvertently operate it.

Figure 9:
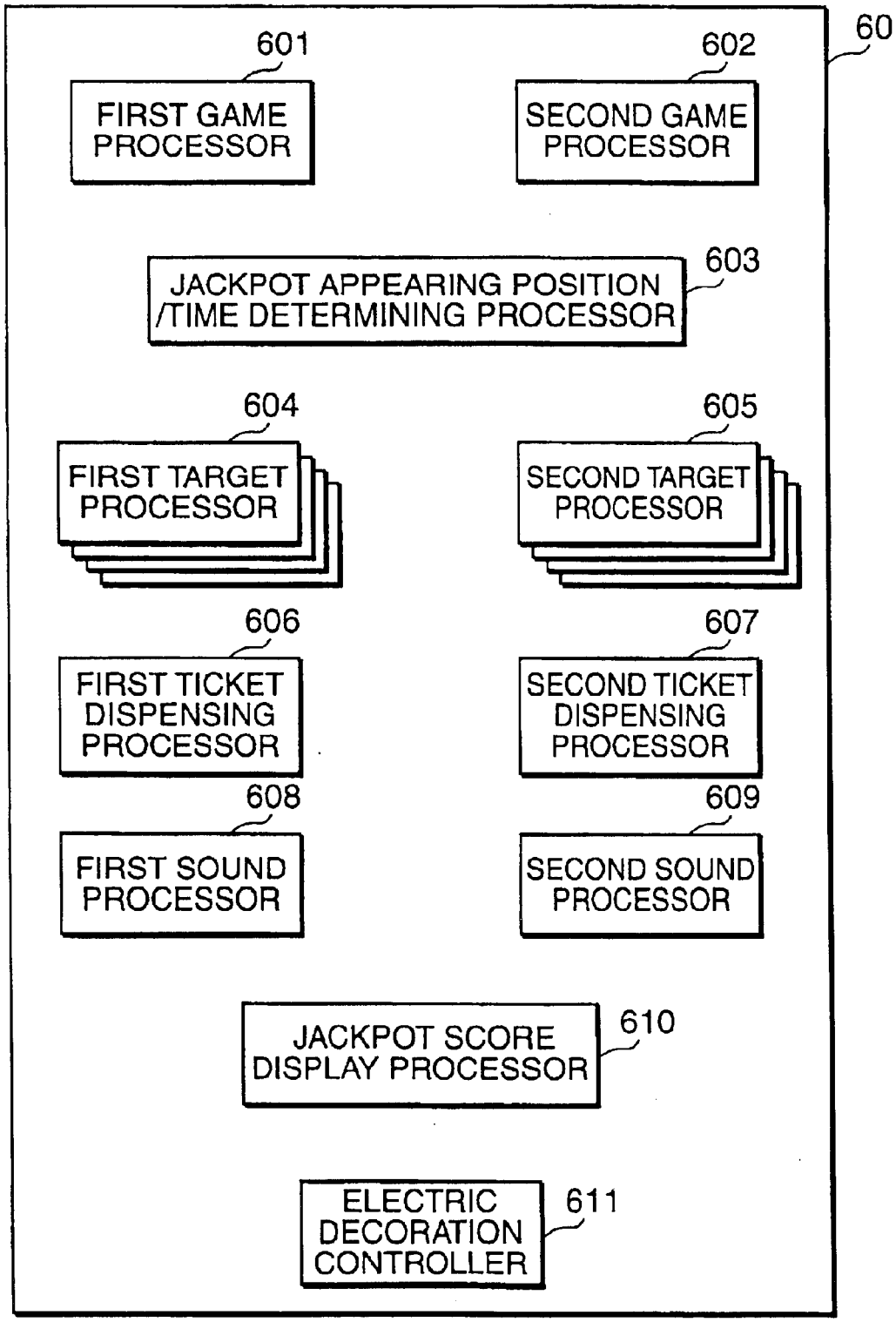
FIG. 9 is a diagram showing a summary of contents of various processings performed by a main control unit.

FIG. 9 is a construction diagram showing a summary of processings performed by the main control unit. These processings are performed in temporal decomposition.

Figure 10:
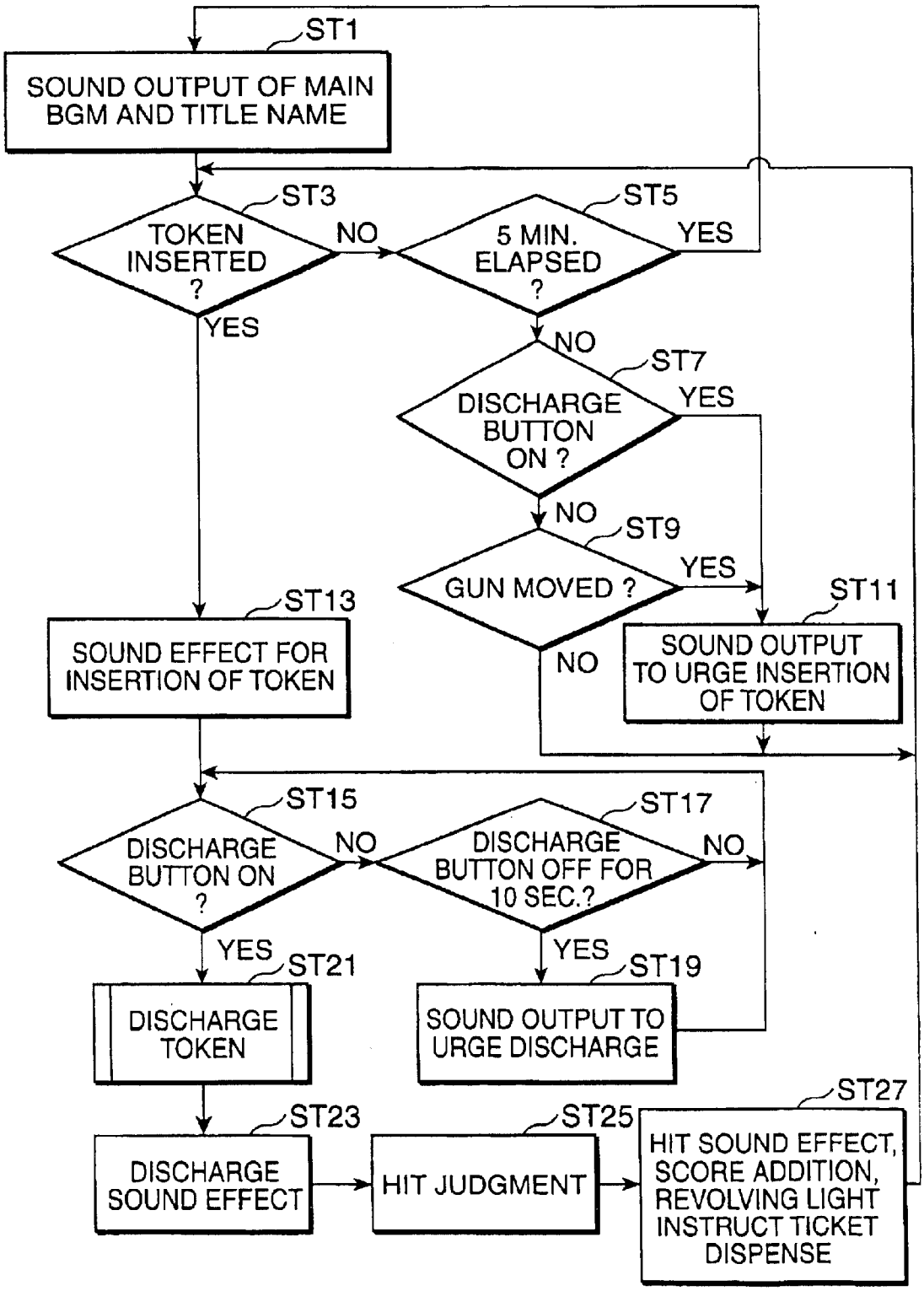
FIG. 10 is a flow chart showing a procedure of "Game Processing"

A first and a second game processor 601, 602 carry out a flow chart shown in FIG. 10, i.e., confirmation of the insertion of the token, confirmation of an operated state of a discharge button 238, processing to the token discharge device 20 upon discharge of the token (flow chart shown in FIG. 11), hit judgment, etc. A jackpot appearing position/time determining processor 603 carries out a flow chart shown in FIG. 12 and determines the target where the jackpot will appear and appearing times at the respective targets. A first and a second target processor 604, 605 carry out a flow chart shown in FIGS. 13 and 14, i.e., making displays in the display unit 317 and the presentation display unit (317*c*, 317R, 317B) of each target, determining the scores for the respective targets and performing a hit judgment. A first and a second ticket dispensing processor 606, 607 carry out a flow chart shown in FIG. 15, i.e., ticket dispensing processing and maintenance of the dispensers 40.

A first and a second sound processor carry out an acoustic processing. A jackpot score display processor 610 displays a numerical value in the score display unit 35. An electric decoration controller 611 turns the revolving light 13 on and off and blinks it. The operations performed by the respective processors are described below.

FIG. 10 is a flow chat showing a procedure of "Game Processing". First, a sound output processing for a main background music (BGM) and a title name are made and applied to the loudspeakers 14 (Step ST1). Then, the insertion of the token is judged based on a detection signal from the token insertion sensor 215 (Step ST3) and it is paused on standby for a specified time, for example, 5 min., until the token is inserted (Step ST5) if the token is judged not to have been inserted. This routine returns to Step ST1 if 5 min. lapse without detecting the insertion of the token.

On the other hand, it is discriminated based on a state signal from the discharging direction sensor 237 whether the discharge button has been turned on (Step ST7) and whether the token discharge device 20 (GUN) has been rotated (Step ST9) during 5 min. during which the insertion of the token is detected. If the discrimination result of either Step ST7 or ST9 is affirmative, a sound guide urging the game player to insert a coin, i.e., the token, is made via the loudspeakers 14 (Step ST11).

If the insertion of the token is detected in Step ST3, a sound effect representative thereof is given via the loudspeakers 14 (Step ST13) and it is then discriminated whether the discharging button 238 has been turned on (Step ST15). Unless the discharging button 238 has been turned on, this routine waits on standby for a predetermined time, for example, 10 sec. (Step St17). Unless the discharging button 238 is turned on during this predetermined time, a sound guide urging the game player to discharge is given via the loudspeakers 14 (Step ST19).

On the other hand, a subroutine "Token Discharging Processing" is executed (Step ST21) and a discharging sound effect is given via the loudspeakers 14 (Step ST23). Subsequently, a hit judgment is made based on a detection signal from the impact sensor device 316 (Step ST25). If the hit judgment is affirmative, a hit sound effect is given via the loudspeakers 14 or the revolving light 13 is turned on (when the jackpot is hit), a score displayed in the display unit corresponding to the hit target (for example, display unit 317 in the case of the target 31) is added to a current score, and an instruction is given to pay out tickets corresponding to a current accumulated score (Step ST27).

Figure 11:
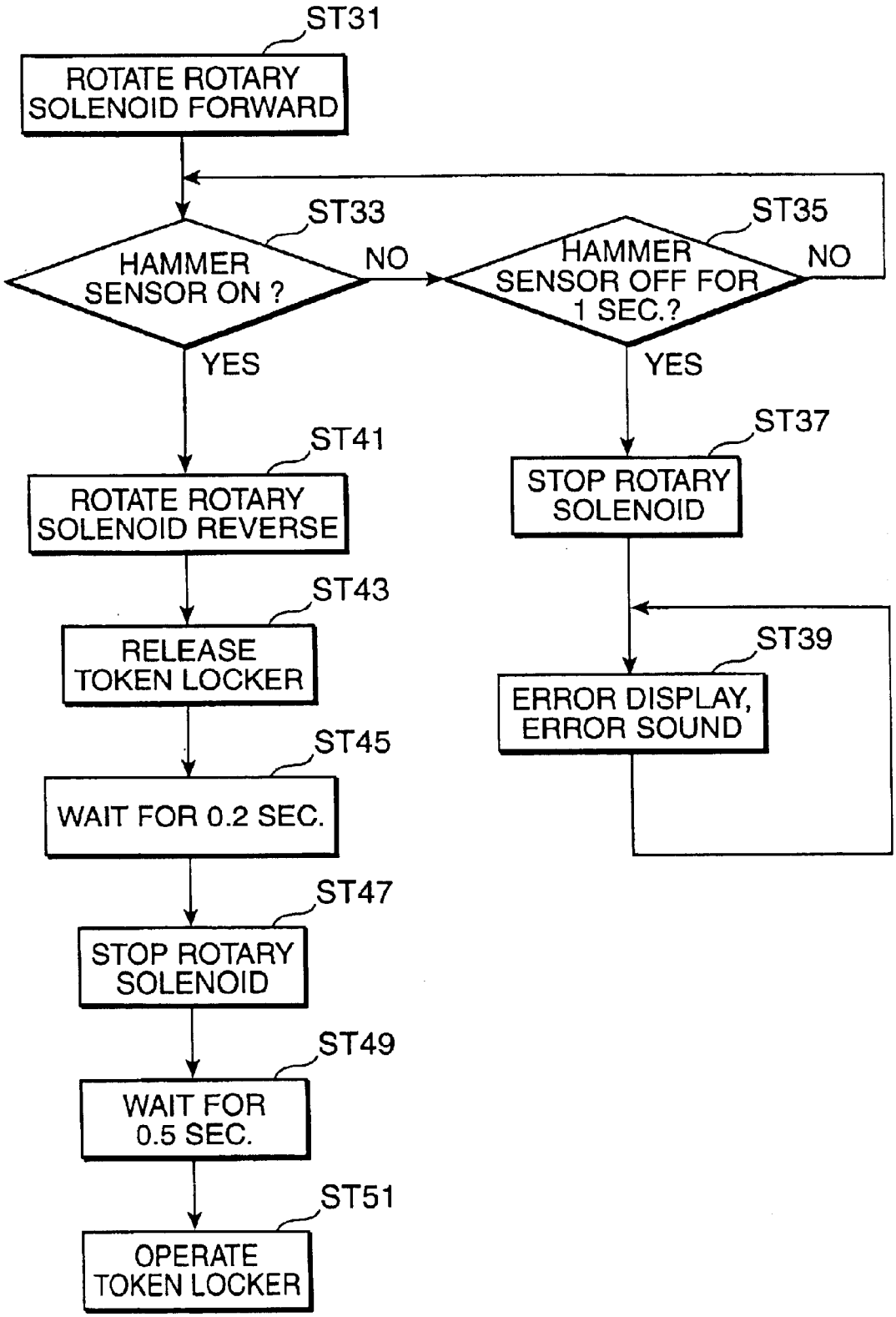
FIG. 11 is a flow chart showing a procedure of "Token Discharge Processing"

FIG. 11 is a flow chart showing a procedure of a subroutine "Token Discharge Processing". When the discharging button 238 is turned on, the rotary solenoid 224*a* is rotated in forward direction (Step ST31) and it is discriminated whether the hammer 224*c* has been returned to the pulled position based on the presence or absence of an ON-signal from the hammer sensor 224*g* (Step ST33). If there is no ON-signal from the hammer sensor 224*g*, this subroutine waits on standby for a predetermined time, for example, 1 sec. (Step ST35). If the hammer sensor 224*g* is not turned on even after the lapse of 1 sec., the driving of the rotary solenoid 224*a* is stopped (Step ST37) and an error notification is given by, for example, making corresponding displays in the jackpot score display unit 35 and the display unit 317*e* and a corresponding sound guide via the loudspeakers 14 (Step ST39).

On the other hand, if the hammer sensor 224*g* is turned on, the rotary solenoid 224*a* is driven in a reverse direction (Step ST41) and the pin of the token locker 225*f* is retracted (Step ST43), thereby performing a token discharging operation. Subsequently, after the hammer 224*c* is caused to wait on standby at the shooting position by maintaining a power application to the rotary solenoid 224*a* for a predetermined time, for example, 0.2 sec. (Step ST45), the power application is stopped (Step ST47). If the power application to the rotary solenoid 224*a* is stopped, the hammer 224*c* is held at the shooting position by the biasing force of the spring 221.

After waiting on standby for a predetermined time, for example, 0.5 sec. (Step ST49), the pin of the token locker 225*f* is caused to project into the discharge path in order to engage a token inserted next at the shooting position (Step ST51).

Figure 12:
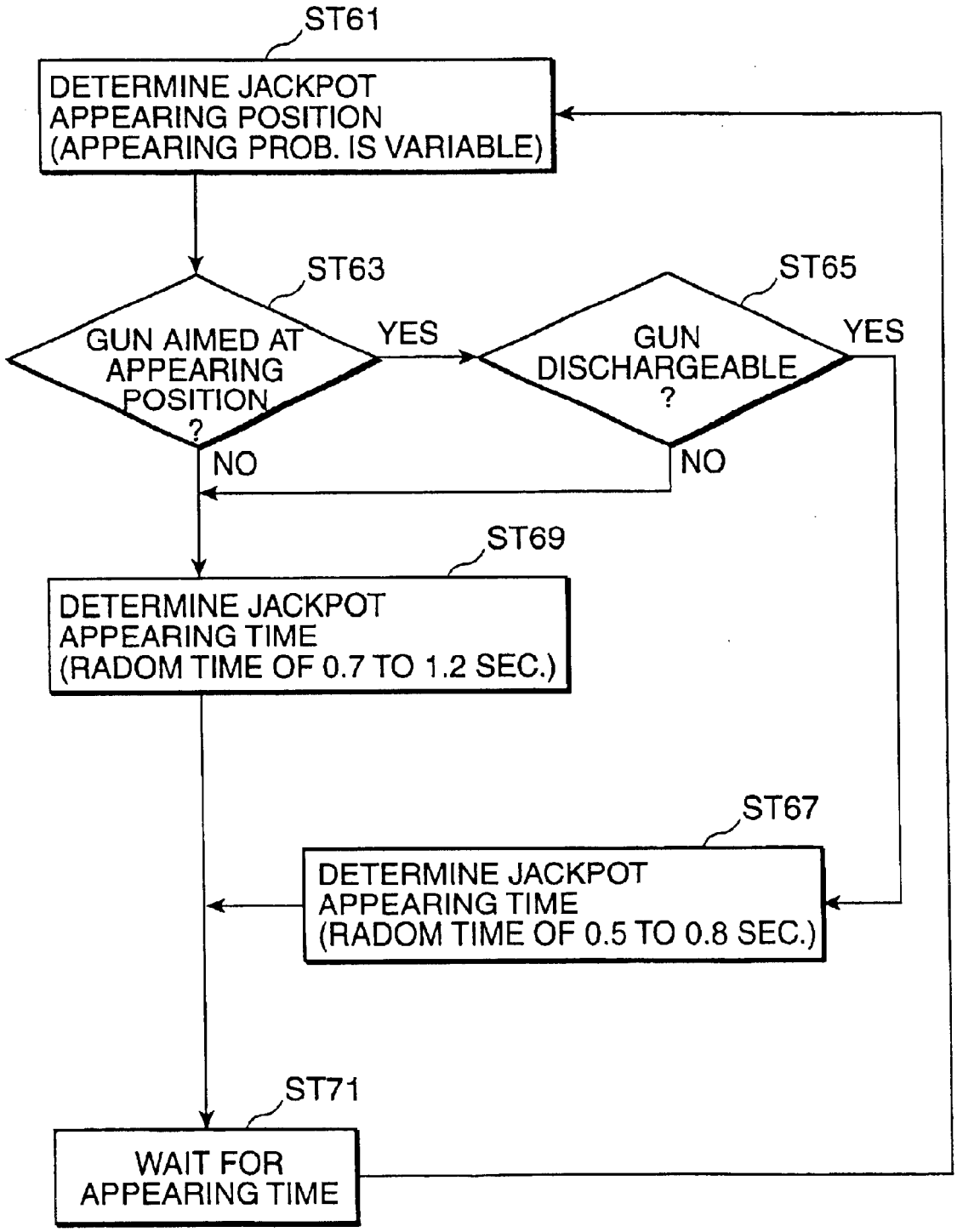
FIG. 12 is a flow chart showing a procedure of "Jackpot Appearing Position/Time Determining Processing"

FIG. 12 is a flow chart showing a procedure of a subroutine "Jackpot Appearing Position/Time Determining Processing". First, an appearing position of the jackpot is determined. The jackpot is randomly determined at any of a total of 8 targets of the first and second target units 30 (Step ST61). It is then discriminated based on the state signal from the discharging direction sensor 237 whether the target where the jackpot has appeared is at a position aimed by the gun 20 (Step ST63). If this target is aimed at, it is then discriminated whether the gun 20 is in a token dischargeable state where it can discharge the inserted token (Step ST65). Here, if the gun 20 is in the token dischargeable state, an appearing time of the jackpot is determined (Step ST67). This time is variably set between 0.5 sec. to 0.8 sec. at random by, for example, 0.1 sec. On the other hand, if the gun 20 is not in the token dischargeable state, the jackpot appearing time is variably set between 0.7 sec. to 1.2 sec. at random by, for example, 0.1 sec. (Step ST69). A degree of difficulty to hit the jackpot is adjusted, i.e., increased by setting the appearing time shorter when the gun 20 is aimed at the jackpot-appearing target and is in the token dischargeable state than otherwise.

Subsequently, the determined time is monitored by a built-in timer for measuring the jackpot appearing time at the target (Step ST71). Upon the lapse of the determined appearing time, this subroutine returns to Step S61 to repeat similar operations.

Figure 13:
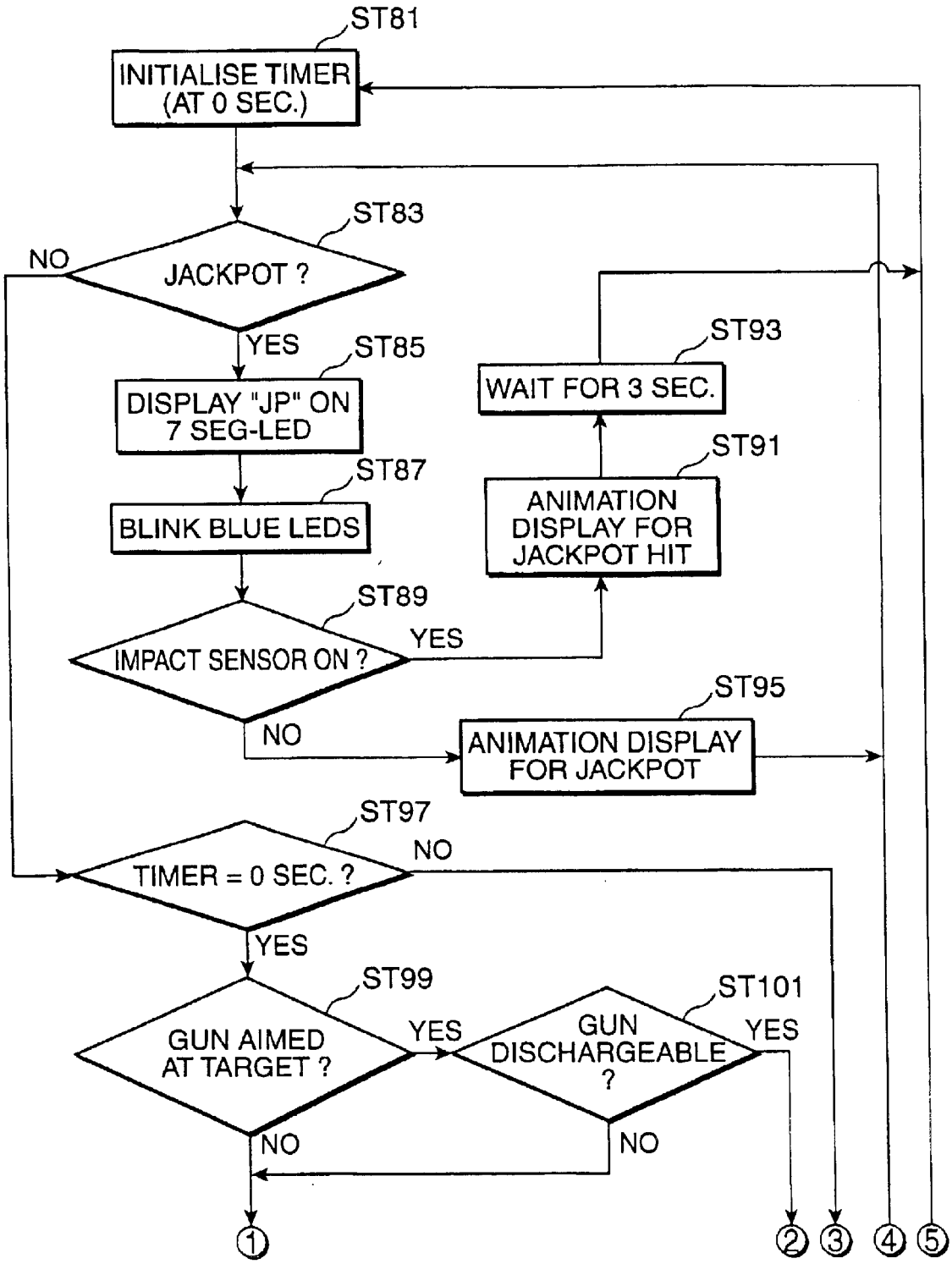
FIGS. 13 and 14 is a flow chart showing a procedure of "Target Processing"
Figure 14:
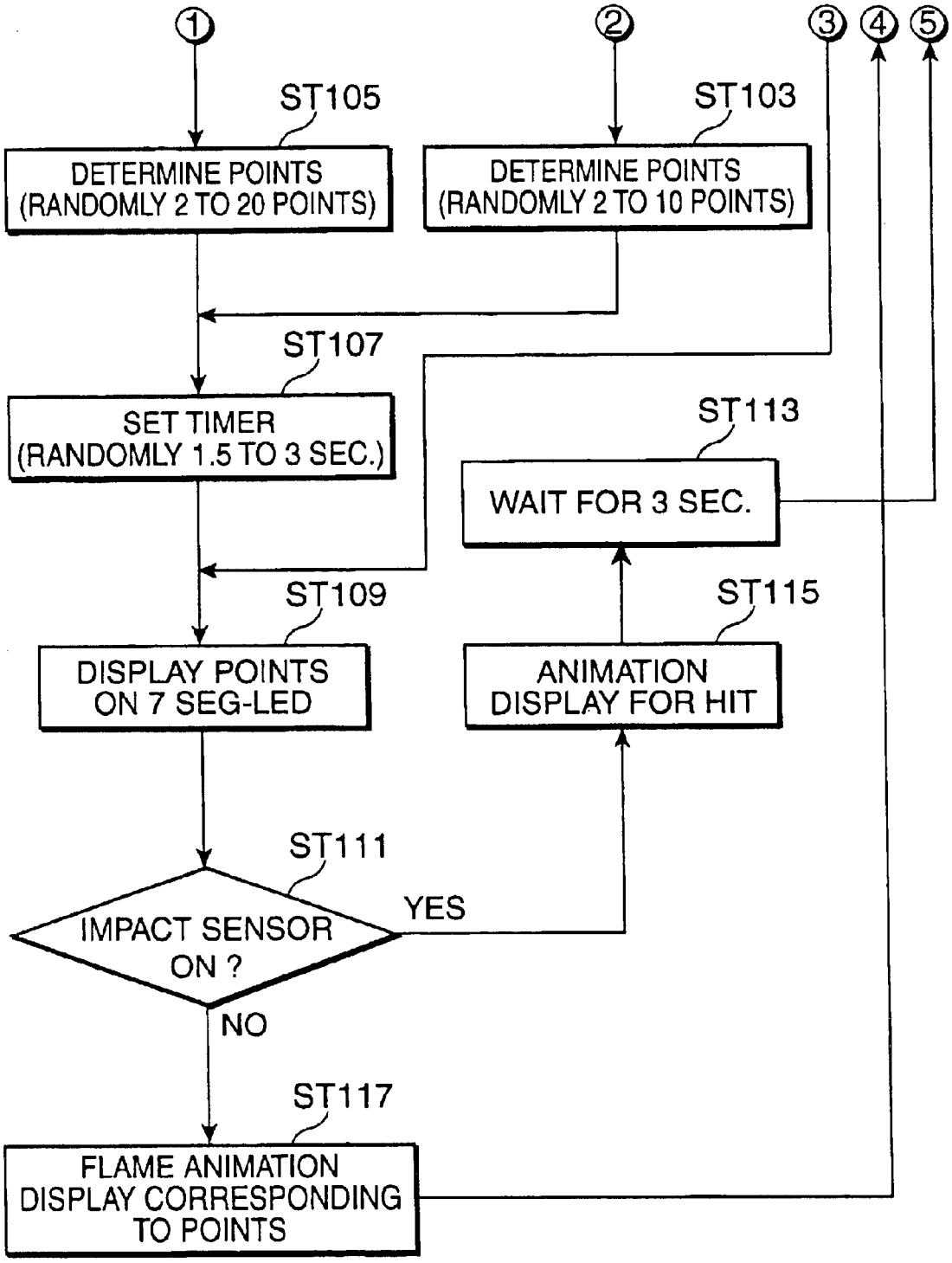

FIGS. 13 and 14 are a flow chart showing a subroutine "Target Processing". This processing is repeated for the targets 31 to 34 of the two target units 30, i.e., 8 targets in this embodiment. Here, operations are described assuming that the first target processing is applied to the target 31 after the power application to the game machine.

First, the built-in timer for measuring the appearing time is set at an initial value, i.e., 0 sec. (Step ST81). It is then discriminated whether the target 31 is a jackpot-appearing target (Step ST83). This subroutine proceeds to Step ST97 unless the target 31 is a jackpot-appearing target, whereas "JP" representing the jackpot is displayed in the display unit 317*e* comprised of two 7-segment LEDs (Step ST85) and the blue LEDs 317B are controllably blinked (Step ST87).

Subsequently, it is discriminated whether the impact sensor 316*c* corresponding to the target 31 (where the jackpot is set) has been turned on (Step ST89). If this sensor 316*c* is on, an animation display representing the hit of the jackpot is made using the red LEDs 317R and the blue LEDs 317B (Step ST91). Specifically, from a state where a flame is expressed by turning some of the red LEDs 317R as shown in FIG. 7A (or the flame is more realistically presented by turning different red LEDs 317R on over time) before the hit judgment, the red LEDs 317R are successively turned on in outward direction to represent scattering of the flame and finally all the red LED 317R are turned off. In this way, a fire extinguishing activity is presented when the jackpot is hit. This subroutine returns to Step ST81 after such an animation display is made for 3 sec. (Step ST93).

Conversely, if the impact sensor 316*c* is not on, it means that the token has missed the target 31 and accordingly this subroutine returns to Step ST83 after making a flame display which is a usual animation display for the jackpot (Step ST95).

On the other hand, if the target 31 is discriminated not to be a jackpot-appearing target in Step ST83, it is discriminated whether the timer is set at 0 sec. (Step ST97). Since this is the first processing, the timer is set at 0 sec. Accordingly, it is discriminated whether the gun 20 is aimed at this target 31 (Step ST99) and whether the gun 20 is in the token dischargeable state (Step ST101). If the gun 20 is in the token dischargeable state, any desired value between 2 to 10 points is randomly determined as a score to be set for the target 31 (Step ST103). On the other hand, if the gun 20 is not aimed at the target 31 or not in the token dischargeable state, any desired value between 2 to 20 points is randomly determined as a score to be set for the target 31 (Step ST105). In this way, a degree of difficulty is adjusted, i.e., increased by setting the score at a smaller value when the gun 20 is aimed at a usual target which is not the jackpot-appearing target and is in the token dischargeable state than otherwise.

Subsequently, the timer is randomly set at a period between 1.5 to 3.0 sec. by, for example, 0.1 sec. (Step ST107), and the determined score is displayed in the display unit 317*e* comprised of the 7-segment LEDs (Step ST109).

Subsequently, it is discriminated whether the impact sensor 316*c* corresponding to the target 31 has been turned on (Step ST111). If this, sensor 316*c* is on, the animation display representing the normal hit of the target is made using the red LEDs 317R (Step ST113). This subroutine returns to Step ST81 after this animation display is made for 3 sec. (Step ST115). At this time, the timer is set at 0 sec. again, and a new score and a new appearing time are set. On the other hand, if the impact sensor 316*c* is not on, this subroutine returns to Step ST83 after an animation display representing that the token has missed the target, for example, the aforementioned flame presentation display, is made (Step ST117).

If the subroutine returns to Step ST83, it is discriminated in view of the operation in Step ST61 whether the target is a jackpot-appearing target. This subroutine proceeds to Step ST97 unless the target 31 is a jackpot-appearing target. If the appearing time set by the previous appearing time determination has not been counted down to 0 sec. yet (NO in Step ST97), this routine proceeds to Step ST109 to keep displaying the score in the display unit 317*e*.

On the other hand, if the appearing time set by the previous appearing time determination has been counted down to 0 sec. (YES in Step ST97), this routine proceeds to Step ST99 to perform a processing to determine a new score and a new appearing time (Steps ST99 to ST107).

Figure 15:
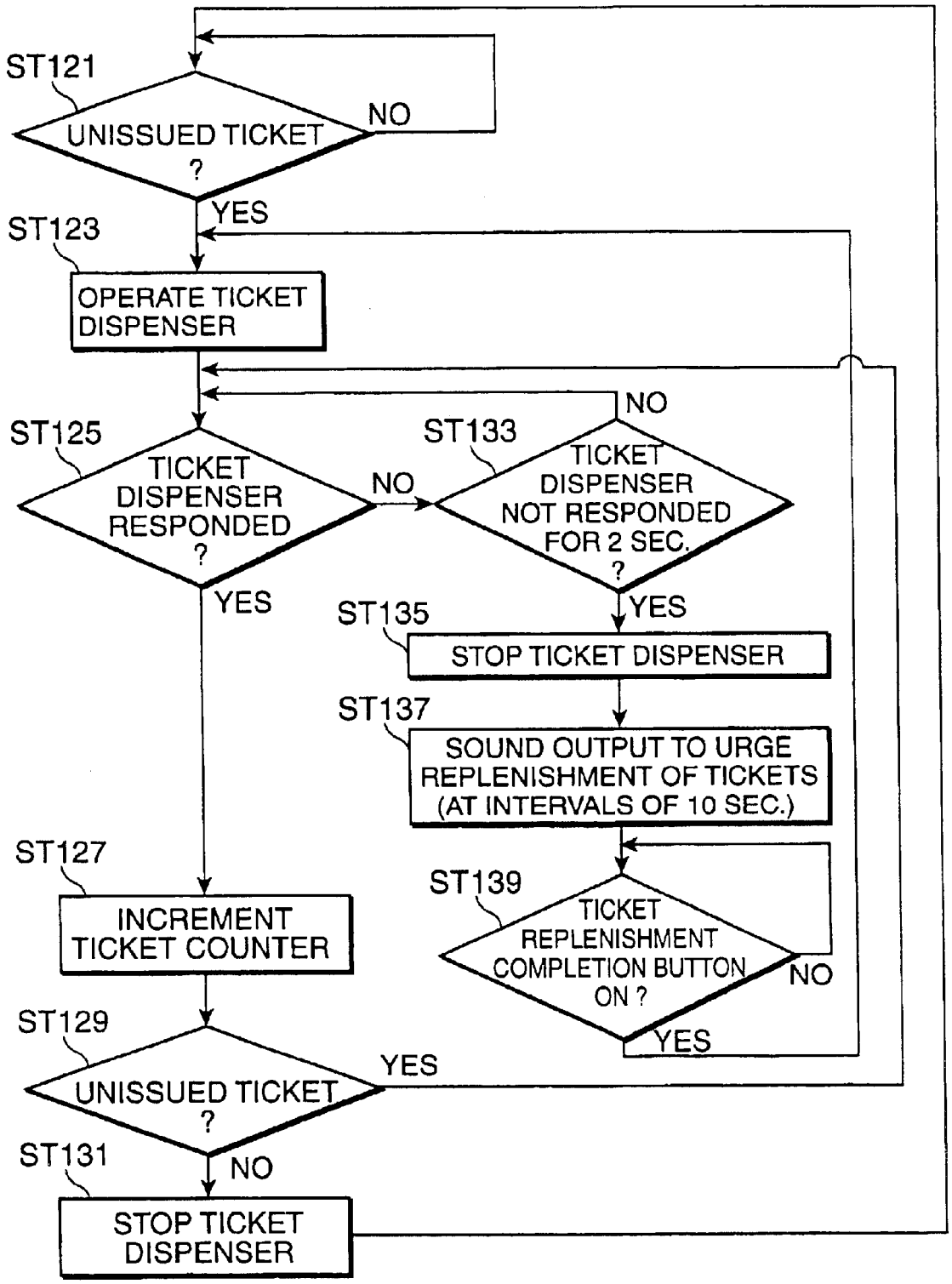
FIG. 15 is a flow chart showing a procedure of "Ticket Dispensing".

FIG. 15 is a flow chart showing a procedure of a subroutine "Ticket Dispensing Processing". First, it is judged whether there is any unissued ticket (Step ST121). This subroutine waits on standby if there is no such ticket, whereas the dispenser 40 is activated (Step ST123) if there is. Subsequently, it is discriminated whether there is any response signal sent upon the start of the operation of the dispenser 40 (Step ST125). If there is a response, a count value of a ticket counter is incremented only by one after paying one ticket Ch out on the assumption that the dispenser 40 is properly operating (Step ST127). It is then discriminated whether the count value has reached a score stored in the storage, i.e., there is any unissued ticket (Step ST129). The operation of the dispenser 40 is stopped if there is no such ticket, whereas this routine returns to ST125 to execute a processing to pay the unissued ticket out after confirming the proper operation of the dispenser 40 if there is such a ticket.

On the other hand, if there is no response in Step ST125, this subroutine waits on standby for 2 sec. (Step ST133), and proceeds to Step ST127 if there is a response during a standby period. If there is no response even after the lapse of 2 sec., the operation of the dispenser 40 is stopped (Step ST135) upon judging that the tickets have run out and a sound guide urging replenishment of tickets is given via the loudspeakers 14 (Step ST137). Here, a game machine administrator replenishes the dispenser 40 with tickets and pushes a ticket replenishment completion button after completion of this operation. The dispenser 40 waits on standby until this ticket replenishment completion button is turned on and starts operating after returning to Step ST123 upon the receipt of an ON-signal.

The present invention may be embodied as follows.

(1) The armed target may be changed and adjusted by adjusting a hitting power instead of adjusting an angle of discharging pad as in the foregoing embodiment. Alternatively, both adjustments may be adopted. The adjustment of the hitting power may be made, for example, by detecting a drive current applied to the rotary solenoid 224*a* through detection of a pushed amount of the discharging button 238 by means of a sensor and setting the hitting power to correspond to the detected level.

(2) The game mediums are not limited to tokens, and may be small balls or the like, or dice-shaped mediums. Further, besides being of the type hitting the game medium by the hammer simulating a gun, the discharge device may be of the type throwing the game medium (e.g. dart), releasing the game medium, or utilizing an approach run and gravity (inclination of an approach-run path is variable). Further, instead of using such instruments, the game player himself may throw or kick the game medium. The construction of the target units 30 is not limited to the one of the foregoing embodiment. A suitable construction can be adopted for the target units 30 depending to the kind and quality of the game to which the invention is applied.

(3) Not necessarily both the score appearing time and the jackpot appearing may be variably determined, but at least one of them may be fixed. Further, they may be randomly determined without including the aiming direction of the hammer as a determination condition.

(4) The scores set for the respective targets and the method for designating the jackpot may be randomly determined without including the aiming direction of the hammer 20 as a determination condition. Alternatively, they may be determined based on a specific rule. Further, instead of varying scores, a plurality of specific scores may be adopted or the fixed scores may be set for the respective targets. A special highest score set as a jackpot value may be randomly determined from a plurality of values prepared in advance or may be fixed.

(5) The jackpot-appearing target may be changed to the target in vicinity of the right previous one, for example, cyclically changed to the target one stage above (or below) in the foregoing embodiment.

Further, the hit of the token at the jackpot may be adopted as a condition in determining the next jackpot-appearing target. For example, if a first token hits the target (or if one of the first few tokens hits the target) after the jackpot is set, the next jackpot-appearing target may be set at an easily aimed position, i.e., at the target right adjacent to the previous one. Further, if a first token hits the jackpot-appearing target in one target unit (or if one of the first few tokens hits this target) during a dual-player game, the next jackpot may appear at the target of the same target unit.

(6) The presentation for the hit of the target corresponding to the jackpot is not limited the one in which the flame at this target is extinguished, but the flames of all the targets may be extinguished. Further, a plurality of sizes of flames may be prepared in advance, and a presentation display may be made according to the determined score. For instance, as the score gets higher, a data on the larger flame may be read for the presentation display.

(7) The presentation display is not limited to the fire extinguishing activity as in the foregoing embodiment, but various presentations may be adopted in relation to kinds of games to which the invention is applied.

(8) The contents to be displayed in the display unit of the target are not limited to the scores (points). In the case of rankable contents (values), various values may be expressed such as "Great Hit", "Hit", "Minor Hit" and "Miss". What is paid out is not limited to tickets, but may be tokens.

(9) In FIG. 6, an opening between the baffle plates 311, 321 defining the target 31 has the same shape as the other targets and this opening functions as a token receptacle. Since the token is discharged in an obliquely upward direction from the token discharge device 20, the token does not horizontally enter any of the targets 31 to 34, and an entering angle to the opening is larger or smaller depending on the height position of each target, i.e., the entering angle becomes smaller at the targets at the upper stages while becoming larger at the targets at the lower stages. Accordingly, by setting the jackpot-appearing targets at the upper stages in higher probability, a degree of difficulty can be adjusted. Conversely, spacing between the baffle plates may be widened toward the above so that the entering angle to every target is equal.

(10) Although the two shooting game machines are incorporated into one casing in the foregoing embodiment, they may be separate. The main control unit may execute a dispensing administration while adjusting some or all of the aforementioned degrees of difficulty in view of the number of inserted coins, the number of paid-out tickets and a difference in value between them lest the dispensing should be excessive.

As described above, according to the present invention, a shooting game machine comprises a target unit including a plurality of targets, a shooting unit provided at a position facing the target unit and operable by a game player to cause a game medium to fly while selectively aiming at any of the plurality of targets, display units provided in correspondence with the respective targets for displaying values corresponding to the targets by codes, value setting means for setting the values to be displayed on the display units, jackpot setting means for setting a jackpot value on one of the display units selectively changed over time, hit detecting means for detecting the hit of the game medium at the target, a dispenser for paying out a material corresponding to the value displayed on the display unit corresponding to the hit target when the game medium hits one target. With this construction, the game player can cause the game medium to fly by operating the discharging unit while aiming at a specific one of the plurality of targets arranged in front. When the aimed target or an other target is hit by the game medium, the value, for example, a specified score, displayed in correspondence with the hit target can be obtained, and the corresponding valued material is paid out from the dispenser. When the target corresponding to the jackpot is hit, the jackpot value, for example, a special high score can be obtained, thereby making the game player's interest in a game vary only to a small degree and stably urging the game player to have a desire to shoot better.

The aforementioned shooting game machine may further comprise presentation display units provided in correspondence with the display units for making a presentation display of a flame, and a presentation display control means for causing each presentation display unit to make the presentation display of the flame and causing it to stop the presentation display when the game medium hits the target corresponding to this presentation display unit. With this construction, such a fire extinguishing activity as to extinguish the flame can be presented when the token hits the target. Such a presentation is particularly effective if the casing of the game machine is designed to simulate a fire engine.

It may be possible that each display unit displays a score set by the value setting means and displays the jackpot value set by the jackpot setting means by a code representing a special high score. With this construction, the construction of the display unit can be effectively utilized since the code representing the jackpot can be displayed on a score display section.

The aforementioned shooting game machine may further comprise a jackpot score display unit for displaying the special high score as the jackpot value. With this construction, a desire to shoot can be roused since the special high score as the jackpot value can be recognizably displayed visually on the jackpot score display unit.

It may be preferable that the value setting means randomly displays a plurality of scores prepared in advance on the display units corresponding to the respective targets. With this construction, gaming nature can be improved since different scores are set for the same target.

It may also be possible that the value setting means randomly displays display times of the scores to be displayed on the display units corresponding to the respective targets. With this construction, a degree of difficulty can be adjusted merely by time.

The aforementioned shooting game machine may further comprise detecting means for detecting an aiming direction by the shooting unit, wherein the jackpot setting means determines the target where the special high score is to be set depending on a detection content of the detecting means. With this construction, a degree of difficulty to hit the jackpot can be made adjustable since the jackpot-appearing target is set in view of the aiming direction of the discharging unit.

In the aforementioned shooting game machine, it may be possible to set design parameters as follows. The plurality of targets are arrayed in vertical directions, game medium receptacles having openings of the same shapes as the targets are provided before the respective targets, the shooting unit discharges the game medium in an angle direction which is inclined upward than horizontal direction, and the value setting means sets a high probability of setting relatively higher scores for the upper targets. With this construction, a degree of difficulty can be substantially set since the entering angle of the game medium into the opening of the game medium receptacle differs according to the height position of the opening from the discharging unit.

Another form of the present invention relates to a shooting game system, which comprises a plurality of shooting game machines according to any one of the above forms in which a plurality of targets are arranged in vertical directions and incorporated into one casing, wherein the jackpot setting means sets the special high score at any one of all targets of the plurality of shooting game machines.

In the aforementioned shooting game system, the shooting game system may include two shooting game machines. With these constructions, a game can be developed in a more complicated manner due to, for example, an unknown factor about in which game machine the jackpot-appearing target is to be set, thereby further rousing a desire to shoot.

In the aforementioned shooting game system, when the target where the special high score is set is hit on a specific condition, the jackpot setting means may be configured to newly set the special high score at any one of the targets of the same target unit other than the target where the special high score was previously set. With this construction, the game player can cause the jackpot to be consecutively set in his game machine by hitting the target corresponding to the jackpot on the specific condition. Therefore, a game system having a more improved gaming nature can be provided.

The present invention is based on Japanese patent application serial No. 2000-290997 filed in Japanese Patent Office on Sep. 25, 2000, the contents of which are hereby incorporated by reference.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds, are therefore intended to embraced by the claims.

What is claimed is:

1. A shooting game machine, comprising:

a target unit including targets;

a shooting unit provided at a position facing the target unit and operable by a game player to cause a game medium to fly while selectively aiming at any of the targets;

display units each being provided in correspondence with a respective one of the targets;

value setting means for setting the values to be displayed on the display units;

jackpot setting means for setting a jackpot value on a particular one of the display units;

hit detecting means for detecting a hit of the game medium at a given one of the targets;

a dispenser for paying out a material corresponding to the value displayed on the display unit corresponding to the given one of the targets when the game medium hits said given one of the targets; and aim detecting means for detecting an aiming direction by the shooting unit, said jackpot setting means determining a one of the targets where the jackpot value is to be set depending on a detection content of the aim detecting means.

2. A shooting game machine, comprising:

a target unit including a plurality of targets to be aimed at by a game player;

a shooting unit provided at a position facing the target unit and operable by a game player to cause a game medium to fly while selectively aiming at any of the targets;

display units for displaying values corresponding to the targets by codes, each of the display units being provided adjacent to and in correspondence with a respective one of the targets;

value setting means for setting the values to be displayed on the display units;

jackpot setting means for setting:

a jackpot position among the display units corresponding to the targets;

a jackpot value on one of the display units; and a jackpot appearing time during which a jackpot appears with the set jackpot value at one of the display units;

hit detecting means for detecting the hit of the game medium at the target;

hit detecting means for detecting a hit of the game medium at a given one of the targets;

aim detecting means for detecting an aiming direction of the shooting unit, the jackpot setting means determining the jackpot appearing time on one of the targets where a special high score corresponding to the jackpot value is to be set based on a detection result of the aim detecting means; and a dispenser for paying out a material corresponding to the value displayed on the display unit corresponding to the given one of the targets when the game medium hits said given one of the targets.

3. A shooting game machine according to claim 2, wherein the jackpot setting means determines the jackpot appearing time on the one of the targets where the special high score is to be set based on a detection result of the aim detecting means regarding whether the shooting unit aims at the target on which the jackpot setting means determines the appearance of jackpot.

4. A shooting game machine according to claim 2, wherein the jackpot sitting means determines the jackpot appearing time on the one of the targets where the special high score is to be set based on a detection result of the detecting means regarding whether the shooting unit aims at the target on which the jackpot setting means determines the appearance of jackpot and whether the shooting unit is loaded with the game medium.

5. A shooting game machine according to claim 4, wherein the jackpot appearing time is set shorter when it is detected that the shooting unit is aiming at the target associated with jackpot and the shooting unit is loaded with the game medium than when the shooting unit is not aiming at the jackpot target.

6. A shooting game machine according to claim 4, wherein the jackpot appearing time is set shorter when it is detected that the shooting unit is aiming at the target associated with jackpot and the shooting unit is loaded with the game medium than when the shooting unit is not loaded with the game medium.

* * * * *